US010857816B2

(12) United States Patent
Asakawa et al.

(10) Patent No.: US 10,857,816 B2
(45) Date of Patent: Dec. 8, 2020

(54) INK JET RECORDING METHOD AND INK JET RECORDING APPARATUS

(71) Applicant: Seiko Epson Corporation, Tokyo (JP)

(72) Inventors: Yuta Asakawa, Azumino (JP); Akira Mizutani, Matsumoto (JP); Akiko Matsuzaki, Matsumoto (JP); Ippei Okuda, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/576,877

(22) Filed: Sep. 20, 2019

(65) Prior Publication Data

US 2020/0094583 A1 Mar. 26, 2020

(30) Foreign Application Priority Data

Sep. 21, 2018 (JP) ..... 2018-177074

(51) Int. Cl.
*B41J 11/00* (2006.01)
*B41J 2/21* (2006.01)

(52) U.S. Cl.
CPC ..... *B41J 11/002* (2013.01); *B41J 2/2114* (2013.01)

(58) Field of Classification Search
CPC ..... B41J 11/002; B41J 3/4078; B41J 3/543; B41J 11/00; B41J 11/0015; B41J 2/2114; B41M 5/0023; B41M 3/00; B41M 7/009
See application file for complete search history.

(56) References Cited

U.S. PATENT DOCUMENTS 5,812,176 A * 9/1998 Kawabe ..... H04N 1/40031 347/237
6,053,595 A * 4/2000 Otsuka ..... B41J 2/1652 347/9
6,102,537 A * 8/2000 Kato ..... B41J 2/17513 347/101
2013/0108842 A1 5/2013 Shiono et al.
2014/0267520 A1* 9/2014 Toda ..... B41J 11/002 347/102
2015/0115202 A1* 4/2015 Kagata ..... C09D 175/04 252/301.36

FOREIGN PATENT DOCUMENTS

JP 2013-095078 A 5/2013
JP 2014-122310 A 7/2014

* cited by examiner

*Primary Examiner* — Kristal Feggins
(74) *Attorney, Agent, or Firm* — Harness, Dickey & Pierce, P.L.C.

(57) ABSTRACT

An ink jet recording method includes an ink attachment step of discharging an aqueous white color ink containing a white color material from an ink jet head onto a recording medium having a white color recording surface with glossiness of 30 or less at an L* value of 75 or more, and attaching the aqueous white color ink onto the recording medium, and a drying step of drying the recording medium onto which the aqueous white color ink is attached, in which a ratio of glossiness of an attachment portion of the aqueous white color ink to the white color recording surface after the drying is two times or more.

12 Claims, 2 Drawing Sheets

INK JET RECORDING METHOD AND INK JET RECORDING APPARATUS

The present application is based on, and claims priority from, JP Application Serial Number 2018-177074, filed Sep. 21, 2018, the disclosure of which is hereby incorporated by reference herein in its entirety.

BACKGROUND

1. Technical Field

The present disclosure relates to an ink jet recording method and an ink jet recording apparatus.

2. Related Art

An ink jet recording method of recording an image on a recording medium by discharging minute ink droplets from a nozzle of a discharge head of an ink jet recording apparatus is known. In recent years, the method has been used not only in recording an image on a recording medium excellent in ink absorbency such as normal paper but also in recording an image on a low absorptive recording medium having low ink absorbency such as art paper and coat paper, or a non-absorptive recording medium almost not absorbing ink such as a plastic film. Even in recording of an image on such a low absorptive recording medium or a non-absorptive recording medium, an aqueous ink jet ink based on water has been used.

In the related art, an aqueous ink jet ink containing a white color material has been used for the purpose of forming a white image on a recording medium of which the recording surface is transparent or not white, among the low absorptive recording medium or the non-absorptive recording medium. For example, as disclosed in JP-A-2013-95078, there is disclosed an ink jet recording method including a first recording step of recording a white image, using an aqueous ink jet ink containing a white color material, on a non-absorptive recording medium, a drying step of drying the white color image to obtain a drying rate of 40% to 80%, and a second recording step of recording a colored image on the white color image having the dryness of 40% to 80% by an ink jet method using a coloring ink containing a color material other than a white color material.

In addition, as disclosed in JP-A-2014-122310, obtaining a print material having a high whiteness using an ink jet ink containing a white hollow particle in which the content of particles having a porosity of 40% to 80%, a number average particle diameter of 50 nm to 200 nm, and a particle diameter of 1 μm or more is 1000 ppm or less is known.

An aqueous ink jet ink having water as a main solvent has a content ratio of a volatile organic compound lower than an ink jet ink other than a non-aqueous ink jet ink, and thus is excellent from a viewpoint of low environmental load, and print suitability for a recording product used for interior decoration is high. In a case of such a recording product, there is demand for a recording product having high designability and a sense of glossiness.

In the ink jet recording method of JP-A-2013-95078 or the recording method using an ink jet ink of JP-A-2014-122310, a method of preparing a recording product having a sense of glossiness by forming a white image on a recording medium which is white and has a recording surface with irregularity by using an aqueous ink jet ink containing a white color material has not been clarified.

In addition, as a method of realizing a sense of glossiness, in general, a method of recording on a recording medium by an ink jet method using an aqueous clear ink not containing a color material but containing a resin is known. The method generates smoothness of an ink attachment portion to exhibit a sense of glossiness. However, there has been a problem that, in a case of a recording medium used for interior decoration, for example, wall paper or cloth, there are many recording media having fiber properties or texture on the surface thereof, and thus it is difficult to obtain a recording product having a sense of glossiness even if the aqueous clear ink is used.

SUMMARY

An ink jet recording method of the present application includes an ink attachment step of attaching an aqueous white color ink containing a white color material onto a recording medium having a white color recording surface with glossiness of 30 or less at an L* value of 75 or more, by an ink jet method, and a drying step of drying the recording medium onto which the aqueous white color ink is attached, in which a ratio of glossiness of an attachment portion of the aqueous white color ink to the white color recording surface after the drying is two times or more.

In the ink jet recording method, an attachment amount of the aqueous white color ink per unit area of the recording medium in the ink attachment step may be 8 mg/inch$^2$ or more.

In the ink jet recording method, a content of the white color material in the aqueous white color ink may be 5% by mass to 14% by mass.

In the ink jet recording method, an average particle diameter of the white color material may be 200 nm to 380 nm.

In the ink jet recording method, the aqueous white color ink may contain a resin, and a content of the resin in the aqueous white color ink may be 5% by mass to 11% by mass.

In the ink jet recording method, glossiness of the white color recording surface of the recording medium may be 10 or less.

In the ink jet recording method, a centerline average roughness Ra in the white color recording surface of the recording medium may be 2 μm or more.

In the ink jet recording method, the recording medium may be a low-absorptive recording medium or a non-absorptive recording medium.

In the ink jet recording method, the ink attachment step may further include attaching an aqueous clear ink onto the recording medium.

In the ink jet recording method, a surface temperature of the recording medium in the attaching of an ink may be 28° C. to 50° C.

In the ink jet recording method, in the drying step, a surface of the recording medium may be dried at 60° C. to 120° C.

An ink jet recording apparatus of the present application performs recording by any of the above-described ink jet recording methods.

DESCRIPTION OF EXEMPLARY EMBODIMENTS

Figure 1:
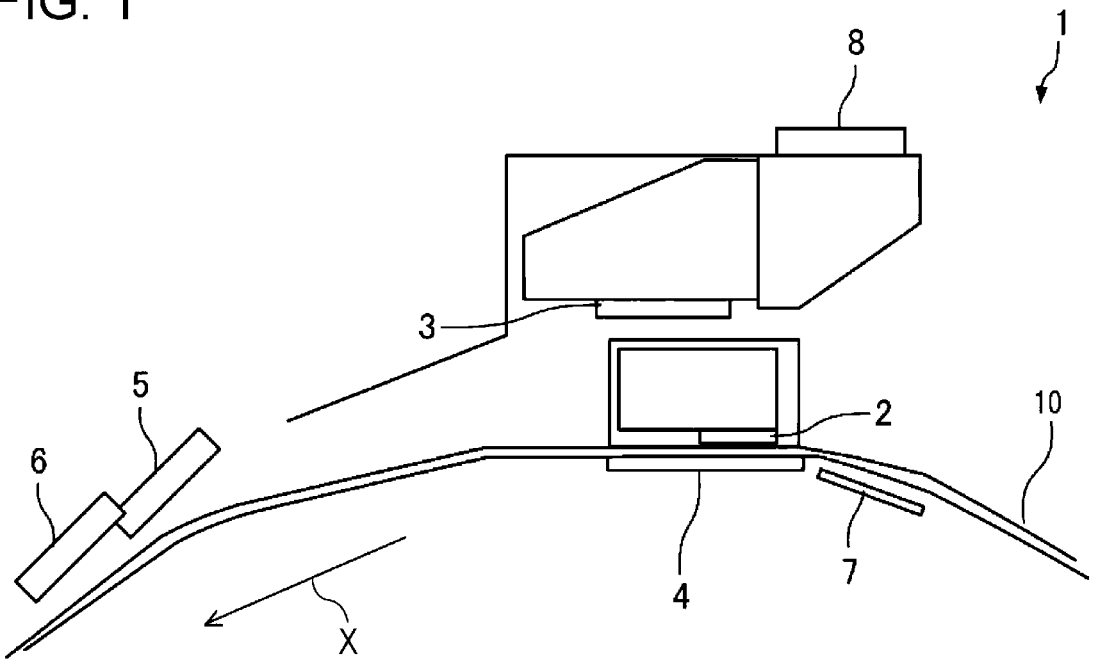
FIG. 1 is a schematic sectional view illustrating a configuration of an ink jet recording apparatus.

Hereinafter, a preferable embodiment of the present disclosure (hereinafter, referred to as "present embodiment") will be described referring to the drawings depending on the necessity. An embodiment to be described hereinafter describes an example of the present disclosure. In addition, the present disclosure is not limited to the following embodiment, and includes various modification examples performed within a scope not changing the gist of the present disclosure.

An ink jet recording method according to an aspect of the present embodiment includes an ink attachment step of attaching an aqueous white color ink containing a white color material onto a recording medium having a white color recording surface with glossiness of 30 or less, at an L* value defining whiteness of 75 or more, by an ink jet method, and a drying step of drying the recording medium onto which the aqueous white color ink is attached, in which a ratio of glossiness of an attachment portion of the aqueous white color ink to the white color recording surface after the drying is two times or more.

Hereinafter, an example of the ink jet recording method according to the present embodiment will be described in order of an ink jet recording apparatus, an ink jet head, an aqueous white color ink, an aqueous clear ink, a treatment solution, a recording medium, and an ink jet recording method.

Ink Jet Recording Apparatus

An example of an ink jet recording apparatus with which the ink jet recording method according to the present embodiment is performed is described referring to the drawings.

Figure 2:
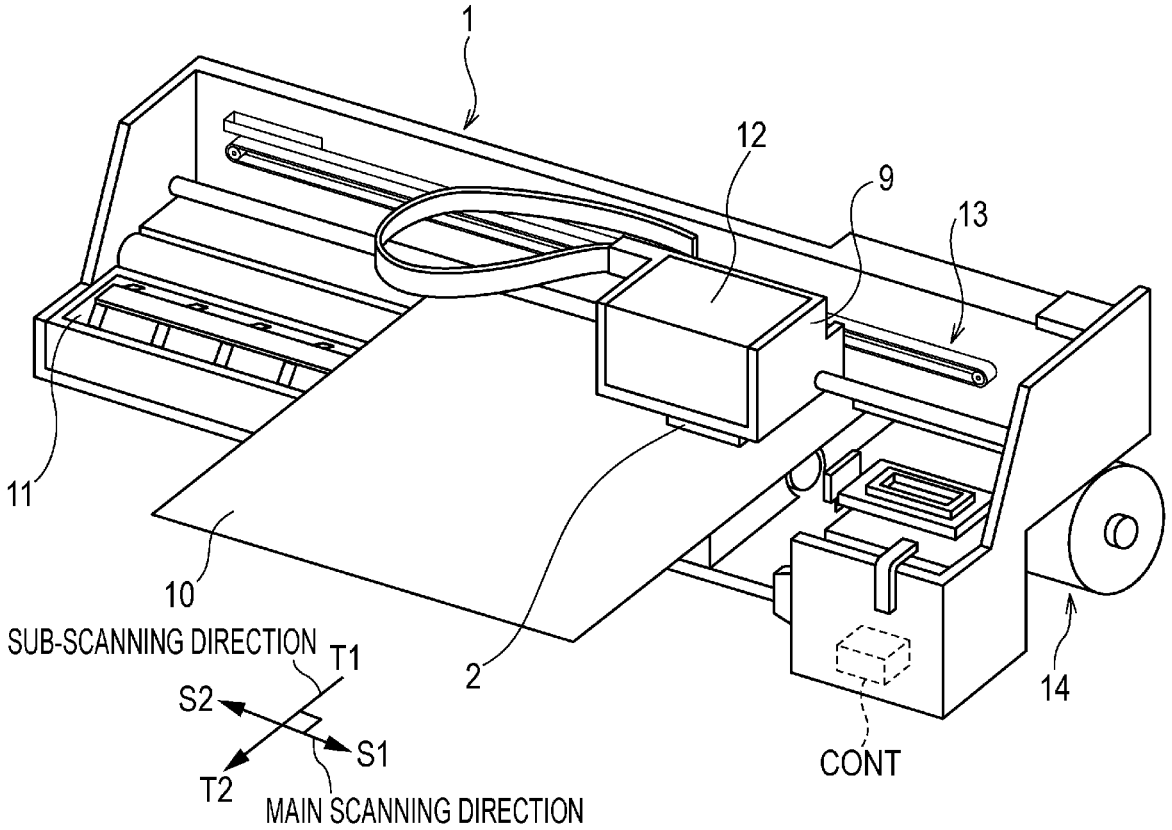
FIG. 2 is a perspective view illustrating an example of a configuration of the periphery of a carriage of the ink jet recording apparatus.

FIG. 1 is a schematic sectional view illustrating an ink jet recording apparatus. FIG. 2 is a perspective view illustrating an example of a configuration of the periphery of a carriage of the ink jet recording apparatus. As illustrated in FIGS. 1 and 2, an ink jet recording apparatus 1 includes an ink jet head 2, an IR heater 3, a platen heater 4, a heater 5, a cooling fan 6, a preheater 7, a ventilation fan 8, a carriage 9, a platen 11, a carriage moving mechanism 13, a motor 14 as a transport unit, and a control section CONT. In the ink jet recording apparatus 1, the control section CONT illustrated in FIG. 2 controls all operations of the ink jet recording apparatus 1.

The ink jet head 2 is a unit performing recording on the recording medium 10 by causing an ink to be discharged from a nozzle (refer to FIG. 3) and to be attached to the recording medium 10. In the present embodiment, the ink discharged from the nozzle of the ink jet head 2 is a collective term for an aqueous white color ink and an aqueous clear ink (hereinafter, also referred to as "clear ink"). Such an ink will be described in detail later. In addition, a treatment solution that flocculates components of an ink may be discharged from the nozzle of the ink jet head 2. The ink jet head 2 may be either of a line type ink jet head (hereinafter, also referred to as "line head") or a serial type ink jet head (hereinafter, also referred to as "serial head"). In a case of the line head, it is possible to record an image on a recording medium by fixing a head, moving the recording medium 10 along a sub-scanning direction (T1-T2 direction in FIG. 2), and discharging ink droplets from the nozzle of the line head in conjunction with the movement. In addition, in a case of the serial head, it is possible to record an image on the recording medium 10 by moving the serial head along a main scanning direction (S1-S2 direction in FIG. 2), and discharging ink droplets from the nozzle of the serial head in conjunction with the movement. This is called main scanning, or simply scanning, or pass. In the present embodiment illustrated in the figure, a serial head is used as the ink jet head 2. The ink jet head 2 is mounted on the carriage 9 illustrated in FIG. 2. The ink jet head 2 performs scanning a plurality of times in the main scanning direction relative to the recording medium 10 by an operation of the carriage moving mechanism 13 that moves the carriage 9 in the main scanning direction of the recording medium 10.

Here, the main scanning direction (hereinafter, also referred to as "MS") is a direction in which the carriage 9 mounting the ink jet head 2 moves. In FIG. 1, the main scanning direction is a direction intersecting the sub-scanning direction (hereinafter, also referred to as "SS") which is a transport direction of the recording medium 10 indicated by an arrow X. In FIG. 2, a width direction of the recording medium 10, that is, the S1-S2 direction is the main scanning direction, and the T1-T2 direction is the sub-scanning direction. Scanning is performed in the main scanning direction, that is, in any of left and right directions of the ink jet recording apparatus 1 by one time of scanning. Recording is performed on the recording medium 10 by alternately repeating the main scanning of the ink jet head 2 and the sub-scanning which is transporting of the recording medium 10. Transporting of the recording medium 10 in the sub-scanning direction is also referred to as sub-scanning.

As an ink discharging method in the ink jet head 2, a known method in the related art can be used. For example, a method of discharging an ink by using a change in volume of an ink accommodation section due to mechanical deformation of a piezoelectric element, a method of generating foam in an ink and discharging thereof by using an electrothermal conversion element such as a heating resistor, and the like can be used. In the present embodiment, the method of discharging an ink by mechanical deformation of a piezoelectric element is used. The details of the configuration of the ink jet head 2 and the periphery of the carriage 9 will be described later.

The ink jet recording apparatus 1 includes the IR heater 3 and the platen heater 4 for primary heating, that is, in order to heat the recording medium 10 in discharging an ink or a treatment solution from the ink jet head 2. In the present embodiment, when heating the recording medium 10 in the ink attachment step, at least one of the IR heater 3 or the platen heater 4 may be used.

When the IR heater 3 is used, it is possible to heat the recording medium 10 from a side of the ink jet head 2. With this, the ink jet head 2 is also easily heated at the same time, but it is possible to raise the temperature without being affected by a thickness of the recording medium 10, compared to a case in which a back surface of the recording medium 10 is heated by the platen heater 4 or the like. In addition, if the platen heater 4 is used in heating the recording medium 10, it is possible to heat the recording medium 10 from a side opposite to the side of the ink jet head 2. With this, the ink jet head 2 is relatively less likely to be heated. A surface temperature of the recording medium 10 heated by the IR heater 3 or the platen heater 4 is also referred to as a primary heating temperature.

An upper limit of the surface temperature of the recording medium 10 heated by the IR heater 3 or the platen heater 4 is preferably 50° C. or less, more preferably 45° C. or less, further more preferably 40° C. or less, and particularly preferably 38° C. or less. In addition, a lower limit of the surface temperature of the recording medium 10 is preferably 25° C. or more, more preferably 28° C. or more, further more preferably 30° C. or more, and particularly preferably 32° C. or more. With this, radiant heat received from the IR heater 3 or the platen heater 4 is small, or radiant heat is not received therefrom, and thus it is possible to suppress drying and compositional variation of an ink in the ink jet head 2, and deposition of the ink or a resin on an interior wall of the ink jet head 2 is suppressed. In addition, it is possible to fix the ink in an early stage and to improve image quality.

The heater 5 dries and solidifies the ink attached onto the recording medium 10. That is, the heater 5 is a secondary heater. As the heater 5 heats the recording medium 10 on which an image is recorded, moisture and the like contained in the ink are more quickly evaporated and scattered, and an ink film is formed by the resin contained in the ink. In this manner, the ink film is firmly fixed or adhered on the recording medium 10, an image excellent in film forming properties and having high image quality and high abrasion resistance is obtained in a short time. An upper limit of the surface temperature of the recording medium 10 heated by the heater 5 is preferably 120° C. or less, more preferably 100° C. or less, and further more preferably 90° C. or less. In addition, a lower limit of the surface temperature of the recording medium 10 is preferably 60° C. or more, more preferably 70° C. or more, and further more preferably 80° C. or more. With the temperature being within the range, an image having high image quality is obtained in a short time. The surface temperature of the recording medium 10 in heated by the heater 5 is also referred to as a secondary heating temperature.

The ink jet recording apparatus 1 may have the cooling fan 6. After drying the ink recorded on the recording medium 10, by the cooling fan 6 cooling the ink on the recording medium 10, it is possible to form an ink coat film having good adhesiveness on the recording medium 10.

In addition, the ink jet recording apparatus 1 may include the preheater 7 that heats the recording medium 10 in advance before the ink is attached onto the recording medium 10. In addition, the ink jet recording apparatus 1 may include the ventilation fan 8 to more efficiently dry an ink or a treatment solution attached onto the recording medium 10.

Below the carriage 9, the platen 11 to which the recording medium 10 is transported, the carriage moving mechanism 13 which moves the carriage 9 relatively to the recording medium 10, a roller that transports the recording medium 10 in the sub-scanning direction, and a motor 14 as a transporting unit driving the roller are provided. Operation of the carriage moving mechanism 13 and the motor 14 is controlled by the control section CONT.

Ink Jet Head

In the present embodiment, the ink jet head 2 discharges an ink or a treatment solution for attachment on the recording medium 10 while being moved by the movement of the carriage 9. With this, in the present embodiment, the ink jet head 2 performs scanning relatively to the recording medium 10 a plurality of times in the main scanning direction to perform recording.

In the present embodiment, a cartridge 12 which feeds an ink or a treatment solution to the ink jet head 2 includes a plurality of independent cartridges. The cartridge 12 is detachably installed in the carriage 9 on which the ink jet head 2 is mounted. In each of a plurality of cartridges 12, different kinds of ink are filled, and an ink or a treatment solution is fed to each nozzle from the cartridge 12. In the present embodiment, an example in which the cartridge 12 is installed in the carriage 9 is exemplified, but the cartridge 12 is not limited thereto, and there may be a form in which the cartridge 12 is provided in a site other than the carriage 9 and the ink or the treatment solution is fed to each nozzle by a feed tube (not illustrated).

Figure 3:
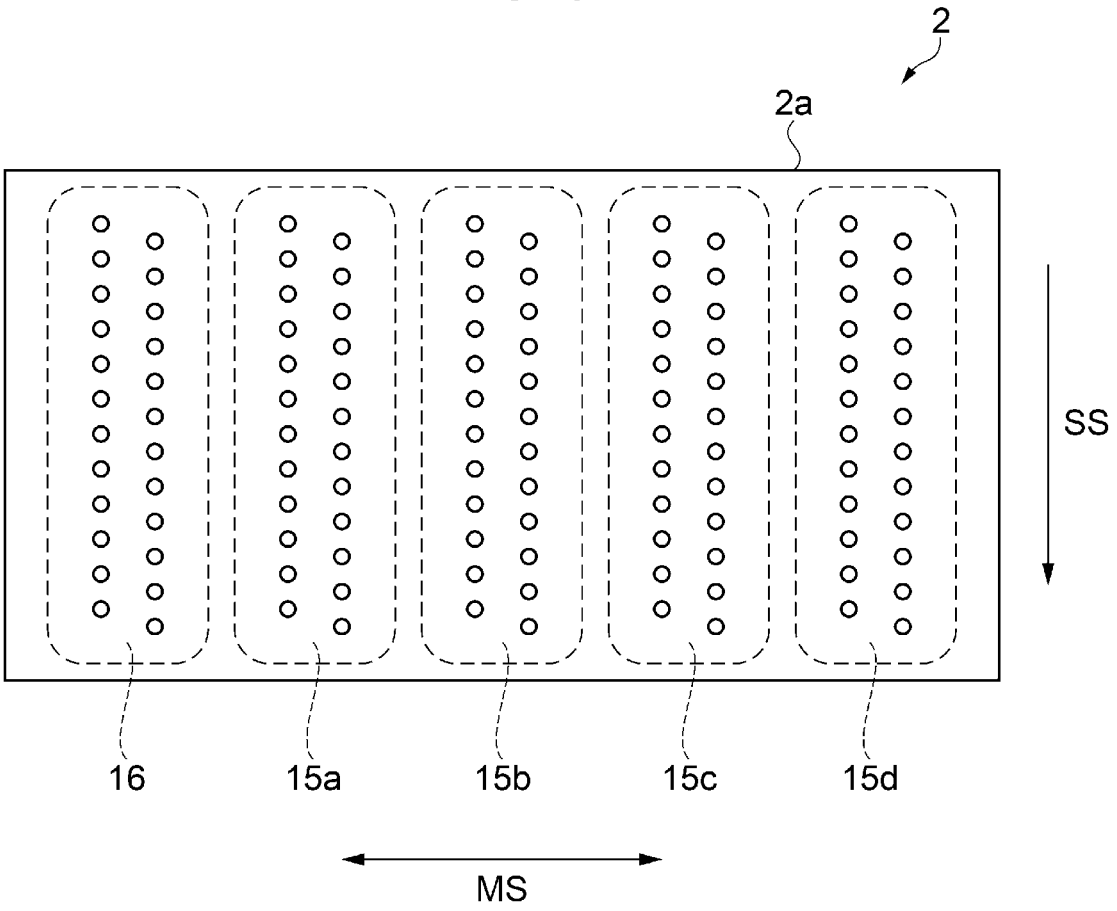
FIG. 3 is a schematic plan view schematically illustrating an example of arrangement of a nozzle group in an ink jet head.

FIG. 3 is a schematic plan view schematically illustrating an example of arrangement of a nozzle group of a nozzle surface in the ink jet head 2. As illustrated in FIG. 3, the ink jet head 2 has a nozzle surface 2*a* including a plurality of nozzles discharging an ink or a treatment solution. In the example illustrated in FIG. 3, the nozzle surface 2*a* of the ink jet head 2 has a plurality of ink nozzle groups 15*a*, 15*b*, 15*c*, and 15*d*, in which a plurality of nozzles from which an aqueous white color ink or a clear ink is discharged is arranged in the sub-scanning direction (SS direction of FIG. 3), and a treatment solution nozzle group 16 from which a treatment solution is discharged. In FIG. 3, the plurality of nozzle groups 15*a*, 15*b*, 15*c*, and 15*d* and the treatment solution nozzle group 16 are respectively formed of two rows of nozzle arrays shifted by a half pitch in the sub-scanning direction, but are not limited thereto. There is no problem even if only some of the plurality of ink nozzle groups 15*a*, 15*b*, 15*c*, and 15*d* are used, and there may be a configuration in which an ink other than an aqueous white color ink or a clear ink (for example, coloring ink such as black ink, cyan ink, magenta ink, and yellow ink) is discharged from some of the plurality of ink nozzle groups 15*a*, 15*b*, 15*c*, and 15*d*. The treatment solution nozzle group 16 may be in plural numbers. In the example illustrated in FIG. 3, the treatment solution nozzle group 16 is one. The plurality of ink nozzle groups 15*a*, 15*b*, 15*c*, and 15*d* and the treatment solution nozzle group 16 are arranged in parallel having an interval in the main scanning direction (MS direction of FIG. 3).

In addition, in the present embodiment, in an example of arrangement of the nozzle groups illustrated in FIG. 3, an example in which the treatment solution nozzle group 16 is at a left end in the main scanning direction of FIG. 3 is exemplified, but there may be an arrangement in which the treatment solution nozzle group 16 is arranged at a right end opposite to the left end in the main scanning direction. In addition, there may be an arrangement in which the treatment solution nozzle groups 16 are arranged at the left end and the right end in the main scanning direction of FIG. 3, respectively. In addition, there may be an arrangement in which the treatment solution nozzle group 16 is arranged between the ink nozzle groups 15*a*, 15*b*, 15*c*, and 15*d* of FIG. 3.

Aqueous White Color Ink

Subsequently, an ink used in the ink jet recording method according to the present embodiment is described.

The ink used in the present embodiment is an aqueous ink jet ink having water as a main component.

A content of water in the aqueous ink jet ink (hereinafter, also referred to as "aqueous ink") is preferably 40% by mass or more, more preferably 45% by mass or more, further more preferably 50% by mass or more, and particularly preferably 60% by mass or more. The aqueous ink can be exemplified as inks of which basic composition is independently the same except that the hue angle is different depending on the different kinds of color materials used.

In addition, in the present embodiment, the ink may contain an organic solvent or may not contain an organic solvent, a content of the organic solvent in the ink is preferably 30% by mass or less, more preferably 25% by mass or less, and particularly preferably 20% by mass or less, with respect to 100% by mass of the ink. In addition, the ink can contain a color material, a resin, a wax, an anti-foaming agent, and a surfactant, depending on the necessity.

In addition, in the present embodiment, the aqueous ink jet ink used is an aqueous white color ink (hereinafter, also referred to as "white color ink") and an aqueous clear ink (hereinafter, also referred to as "clear ink"). Here, the plurality of ink nozzle groups 15*a*, 15*b*, 15*c*, and 15*d* arranged in plural numbers in the sub-scanning direction, present on the nozzle surface 2*a* of the ink jet head 2 may contain a nozzle group from which a coloring ink other than a white color ink is discharged.

As the white color ink, an ink, which is referred to and sold by a name indicating that the ink is a white color ink, is exemplified. In addition, the ink is an ink in which an L* value is 75 or more when the white color ink is attached onto a white color recording surface of the recording medium 10 to be described so as to entirely cover the recording medium 10 with the ink, and the attachment portion is subjected to colorimetry by the same method as for that of the white color recording surface to be described later. In addition, an a* value and a b* value of the colorimetry preferably satisfy $-4.5 \leq a^* \leq 2$ and $-10 \leq b^* \leq 3$, and more preferably satisfy $-2 \leq a^* \leq 1.5$ and $-7 \leq b^* \leq 2.5$.

Hereinafter, components contained in the aqueous white color ink used in the present embodiment and components to be possibly contained are described.

Water

In the present embodiment, the white color ink contains water. Water is a medium that mainly forms the white color ink, and is a component that is evaporated and scattered by drying. Water is preferably water obtained by extremely removing ionic impurities such as pure water or ultrapure water, for example, ion exchange water, ultrafiltration water, reverse osmosis water, and distilled water. In addition, using water sterilized by ultraviolet light irradiation or hydrogen peroxide addition is preferable since it is possible to suppress generation of mold and bacteria in a case of storing the white color ink for a long period of time.

A content of water is preferably 40% by mass or more, more preferably 50% by mass or more, and further more preferably 60% by mass or more, with respect to a total mass of the white color ink. An upper limit of the content of water is not limited thereto, but is preferably 99% by mass or less, for example.

White Color Material

The white color ink used in the present embodiment contains a white color material. As the white color material, any one of a dye or a pigment can be used. The dye has a property of being less likely to be faded by light, gas, and the like, and thus is preferably used. An image formed on a recording medium using a pigment is not only excellent in image quality but also excellent in water resistance, gas resistance, light resistance, and the like and has a favorable storing property. The property is particularly prominent when an image is formed on a low ink absorptive or non-absorptive recording medium.

The pigment usable in the present embodiment is not particularly limited, but an inorganic pigment or an organic pigment is exemplified. As the inorganic pigment, an inorganic metal compound is exemplified, for example. As the inorganic metal compound, for example, C.I. pigment white 6, C.I. pigment white 18, C.I. pigment white 21, titanium oxide, zinc oxide, zinc sulfide, antimony oxide, magnesium oxide, and zirconium oxide can be used. Particularly, metal oxide is preferably exemplified. As the organic pigment, for example, a white color hollow resin fine particle and a polymer particle can be used.

Among the white color pigments, titanium oxide is particularly preferable. Since the titanium oxide has a high refractive index and has a large amount of light reflected against incident light, it is possible to obtain a recording product having a sense of glossiness.

A lower limit of the content of the white color material contained in the white color ink is preferably 5% by mass or more and more preferably 7% by mass or more, with respect to the total mass of the white color ink. On the other hand, an upper limit of the content of the white color material contained in the white color ink is preferably 14% by mass or less and more preferably 12% by mass or less, with respect to the total mass of the white color ink. With the content of the white color material being within the range, an image having favorable storage reliability, sedimentation recovery properties, and discharge reliability, of the white ink, and having a sense of glossiness is obtained.

When the white color material is a pigment, the white color material can be used in a state of a pigment dispersion solution. The pigment dispersion solution may contain a dispersant depending on the necessity, in addition to a pigment and a solvent. As the solvent, a hydrophilic solvent such as water and diethylene glycol is exemplified. In addition, as the dispersant, a styrene-acrylic acid copolymer is exemplified. Although not particularly limited, an acid value of the dispersant is preferably 20 mgKOH/g or more, from a viewpoint of the dispersibility.

Organic Solvent

In the present embodiment, the white color ink preferably contains an organic solvent. With the white color ink containing an organic solvent, clogging resistance of the nozzle due to the ink jet method in recording becomes favorable.

The organic solvent used in the white color ink is preferably a water-soluble organic solvent. By using the water-soluble organic solvent, dryness of the white color ink becomes favorable, and it is possible to obtain an image excellent in image quality and abrasion resistance.

The water-soluble organic solvent is not particularly limited, and examples thereof include alkanediols, polyols, nitrogen-containing solvent, esters, glycol ethers, cyclic ethers, and the like.

Examples of the alkanediols include ethylene glycol, propylene glycol, 1,2-propanediol, 1,2-butanediol, 1,2-penthanediol, 1,2-hexanediol, 1,2-octanediol, and the like, which are 1,2-alkanediols, 1,3-propanediol, 1,4-butanediol, 1,6-hexanediol, and the like. These can be used alone, or two or more thereof can be used by being mixed. The alkanediols are excellent in operation of uniformly wetting the recording medium by enhancing wettability of the ink to the recording medium and operation as a permeating solvent to the recording medium. Among these, 1,2-alkanediols are particularly excellent in operation as a permeating solvent and thus is preferable. As the alkanediols, diols of alkane having 5 or more carbon atoms are preferably exemplified. The alkane preferably has 5 to 9 carbon atoms, and may be straight-chain or branched.

Examples of the polyols include diethylene glycol, triethylene glycol, dipropylene glycol, 2-ethyl-2-methyl-1,3-propanediol, 2-methyl-2-propyl-1,3-propanediol, 2-methyl-1,3-propanediol, 2,2-dimethyl-1,3-propanediol, 3-methyl-1,3-butanediol, 2-ethyl-1,3-hexanediol, 3-methyl-1,5-penthanediol, 2-methylpenthane-2,4-diol, trimethylolpropane, glycerin, and the like. One kind or two or more kinds thereof can be used by being mixed. The polyols are excellent in operation as a moisturizer. Examples of the polyols preferably include alkane including two or more hydroxyl groups having 4 or less carbon atoms and alkane including two or more hydroxyl groups having 4 or less carbon atoms, in which the hydroxyl groups are intermolecularly condensed, and the number of condensations is preferably 2 to 4. Here, the polyols are compounds having two or more hydroxyl groups in molecule, and in the present embodiment, the number of the hydroxyl groups is preferably 2 or 3.

Examples of the nitrogen-containing solvent include pyrrolidones such as N-methyl-2-pyrrolidone, N-ethyl-2-pyrrolidone, N-vinyl-2-pyrrolidone, 2-pyrrolidone, N-butyl-2-pyrrolidone, and 5-methyl-2-pyrrolidone. These can be used alone, or two or more thereof can be used by being mixed. The nitrogen-containing solvent operates as a favorable solubilizer of resin, and it is possible to obtain a recording product excellent in abrasion resistance and to prevent clogging of nozzles of the ink jet head.

An example of the nitrogen-containing solvent includes alkoxy alkyl amides, such as 3-methoxy-N,N-dimethylpropion amide, 3-methoxy-N,N-diethylpropione amide, 3-methoxy-N,N-methylethylpropione amide, 3-ethoxy-N,N-dimethylpropion amide, 3-ethoxy-N,N-diethylpropione amide, 3-ethoxy-N,N-methylethylpropione amide, 3-n-butoxy-N,N-dimethylpropione amide, 3-n-buthoxy-N,N-diethylpropione amide, 3-n-butoxy-N,N-methylethylpropione amide, 3-n-propoxy-N,N-dimethylpropione amide, 3-n-propoxy-N,N-diethylpropione amide, 3-n-propoxy-N,N-methylethylpropione amide, 3-iso-propoxy-N,N-dimethylpropione amide, 3-iso-propoxy-N,N-diethylpropione amide, 3-iso-propoxy-N,N-methylethylpropione amide, 3-tert-butoxy-N,N-dimethylpropione amide, 3-tert-butoxy-N,N-diethylpropione amide, 3-tert-butoxy-N,N-methylethylpropione amide, and the like.

As the nitrogen-containing solvent, an amide-based solvent is also exemplified. As the amide-based solvent, a cyclic amide-based solvent, a non-cyclic amide-based solvent, and the like are preferably exemplified. As the cyclic amide-based solvent, the pyrrolidones are exemplified. As the non-cyclic amide-based solvent, the alkoxyalkyl amides are exemplified.

A content of the nitrogen-containing solvent with respect to the white color ink is preferably 3% by mass to 30% by mass, more preferably 5% by mass to 25% by mass, and preferably 10% by mass to 20% by mass. Since the white color ink contains a nitrogen-containing solvent, the white color ink is preferable from a viewpoint of more excellent abrasion resistance, image quality, and the like.

Examples of the esters include glycol monoacetates such as ethylene glycol monomethyl ether acetate, ethylene glycol monoethyl ether acetate, ethylene glycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, and methoxy butyl acetate, and glycol diesters such as ethylene glycol diacetate, diethylene glycol diacetate, propylene glycol diacetate, dipropylene glycol diacetate, ethylene glycol acetate propionate, ethylene glycol acetate butylate, diethylene glycol acetate butylate, diethylene glycol acetate propionate, diethylene glycol acetate butylate, propylene glycol acetate propionate, propylene glycol acetate propionate, propylene glycol acetate butylate, dipropylene glycol acetate butylate, and dipropylene glycol acetate propionate.

Exemplary glycol ethers include alkylene glycol monoethers and alkylene glycol diethers. In some embodiments, an alkyl ether may be used. Specific examples thereof include alkylene glycol monoalkyl ethers such as ethylene glycol monomethyl ether, ethylene glycol monoethyl ether, ethylene glycol monoisopropyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, propylene glycol monopropyl ether, propylene glycol monobutyl ether, dipropylene glycol monomethyl ether, dipropylene glycol monoethyl ether, dipropylene glycol monopropyl ether, dipropylene glycol monobutyl ether, and tripropylene glycol monobutyl ether, and alkylene glycol dialkyl ethers such as ethylene glycol dimethyl ether, ethylene glycol diethyl ether, ethylene glycol dibutyl ether, diethylene glycol dimethyl ether, diethylene glycol diethyl ether, diethylene glycol dibutyl ether, diethylene glycol methyl ethyl ether, diethylene glycol methyl butyl ether, triethylene glycol dimethyl ether, triethylene glycol diethyl ether, triethylene glycol dibutyl ether, triethylene glycol methyl butyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, dipropylene glycol diethyl ether, and tripropylene glycol dimethyl ether. These can control wettability of the ink and the like with respect to the recording medium.

In addition, in the alkylene glycol, diether tends to easily dissolve or swell a resin in the ink, and is preferable from a viewpoint of improving abrasion resistance of the formed image.

Examples of the cyclic esters include cyclic esters (lactones) such as β-propiolactone, γ-butyrolactone, δ-valerolactone, ε-caprolactone, β-butyrolactone, β-valerolactone, γ-valerolactone, β-hexanolactone, γ-hexanolactone, δ-hexanolactone, β-heptanolactone, γ-hetanolactone, δ-hetanolactone, ε-hetanolactone, γ-octanolactone, δ-octanolactone, ε-octanolactone, δ-nonalactone, ε-nonalactone, and ε-decanolactone, and a compound obtained by substituting hydrogen of a methylene group adjacent to a carbonyl group thereof with an alkyl group having 1 to 4 carbon atoms.

A content of the organic solvent is preferably 1% by mass or more, more preferably 5% by mass or more, and further more preferably 10% by mass or more, with respect to the total mass of the white color ink. In addition, the content of the organic solvent is preferably 40% by mass or less, more preferably 35% by mass or less, and further more preferably 30% by mass or less, with respect to the total mass of the white color ink. When the content of the organic solvent is within the range, clogging resistance or abrasion resistance of the white color ink is more excellent, and thus is preferable.

A standard boiling point of the organic solvent is preferably 180° C. or more, more preferably 200° C. or more, and further more preferably 210° C. or more. In addition, the standard boiling point of the organic solvent is preferably 300° C. or less, more preferably 270° C. or less, and further more preferably 250° C. or less. When the standard boiling point of the organic solvent is within the range, clogging resistance or abrasion resistance of the white color ink is more excellent, and thus is preferable.

Resin

In the present embodiment, the white color ink preferably contains a resin. The resin has an operation of solidifying the white color ink and firmly fixing the ink solidification product on a recording medium. In the present embodiment, the resin may be in any one state of a state of being dissolved in the white color ink and a state of being dispersed in the white color ink. As the resin in the dissolved state, the resin dispersant used in a case of dispersing a pigment of the white color ink can be used. In addition, as the resin in the dispersed state, a resin which is hardly soluble or insoluble to a liquid medium of the white color ink can be contained in a state of being dispersed in a fine particle shape, that is, in an emulsion state or a suspension state.

The resin used in the present embodiment is not particularly limited, and examples thereof include an acrylic resin, a vinyl acetate resin, a vinyl chloride resin, a butadiene resin, a styrene resin, a polyester resin, a crosslinking acrylic resin, a crosslinking styrene resin, a benzoguanamine resin, a phenol resin, a silicone resin, an epoxy resin, an urethane resin, a paraffin resin, a fluorine resin, a water-soluble resin, and a copolymer obtained by combining monomers constituting these resins. The copolymer is not particularly limited, and examples thereof include a styrene butadiene resin, a styrene acrylic resin, and the like. In addition, as the resin, polymer latex including these resins can be used. Examples thereof include polymer latex including fine particles of an acrylic resin, a styrene acrylic resin, a styrene resin, a crosslinking acrylic resin, and a crosslinking styrene resin. One kind of the resin may be used, or two or more kinds thereof may be used in combination.

The acrylic resin is a resin which is a monomer or a copolymer obtained by performing polymerization using at least an acrylic monomer as a monomer. Examples of the acrylic monomer include (meth)acrylate, (meth)acrylic acid, acrylamide, acrylonitrile, and the like. When the acrylic resin is a copolymer, an acryl-vinyl resin using a vinyl monomer as another monomer is exemplified, and among these, a styrene acrylic resin using styrene as a vinyl monomer and the like are exemplified. Among these resins, the acrylic resin, the urethane resin, the polyester resin, and the like are preferable from a viewpoint of easy acquisition and obtainability as a resin having desired properties.

A lower limit of the sum of the content of the resin is preferably 5% by mass or more and more preferably 6% by mass or more, with respect to the total mass of the white color ink in terms of solid content. In addition, an upper limit of the content of the resin is preferably 11% by mass or less and more preferably 10% by mass or less, with respect to the total mass of the white color ink. With the content of the resin being within the range, it is possible to ensure clogging resistance in recording, and to form an image excellent in abrasion resistance, even on a low-absorptive or non-absorptive recording medium with respect to the white color ink.

Surfactant

In the present embodiment, the white color ink preferably contains a surfactant. The surfactant is not particularly limited, but examples thereof include an acetylene glycol-based surfactant, a fluorine-based surfactant, and a silicone-based surfactant, and the surfactant preferably contains at least one of these, and more preferably contains a silicone-based surfactant among these. As the white color ink contains a silicone-based surfactant, dynamic surface tension of the white color ink is lowered. Therefore, it is possible to improve clogging resistance and to ensure discharge reliability.

The acetylene glycol-based surfactant is not particularly limited, and examples thereof include Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (all hereinabove are product names, manufactured by Air Products and Chemicals, Inc.). In addition, examples thereof include Olefin B, Y, P, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (all hereinabove are product names, manufactured by Nissin Chemical Co., Ltd.). In addition, examples thereof include Acetylenol E00, E00P, E40, and E100 (all hereinabove are product names, manufactured by Kawaken Fine Chemicals Co., Ltd.).

The silicone-based surfactant is not particularly limited, but a polysiloxane compound is preferably exemplified. The polysiloxane compound is not particularly limited, but a polyether-modified organosiloxane is exemplified. Examples of a commercially available product of the polyether-modified organosiloxane include BYK-306, BYK-307, BYK-333, BYK-341, BYK-345, BYK-346, and BYK-348 (all hereinabove are product names, manufactured by BYK Japan), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (all hereinabove are product names, manufactured by Shin-Etsu Chemical Co., Ltd.).

The fluorine-based surfactant is not particularly limited, and examples thereof include perfluoroalkylsulfonate, perfloroalkylcarboxylic acid salt, perfluoroalkyl phosphate, perfluoroalkyl ethylene oxide adduct, perfluoroalkyl betaine, and perfluoalkylamine oxide compound. The commercially available product of the fluorine-based surfactant is not particularly limited, but examples thereof include S-144, S-145 (all hereinabove are product names, manufactured by AGC Inc.), FC-170C, FC-430, Fluorad FC4430 (all hereinabove are product names, manufactured by Sumitomo 3M Limited), FSO, FSO-100, FSN, FSN-100, FS-300 (all hereinabove are product names, manufactured by Du Pont), and FT-250, 251 (all hereinabove are product names, manufactured by Neos Corporation).

When a surfactant is contained, the content can be 0.1% by mass to 1.5% by mass, and is preferably 0.5% by mass to 1% by mass, with respect to the total mass of the white color ink.

Wax

In the present embodiment, the white color ink may contain a wax. As the wax, a wax dissolved in the white color ink or a wax dispersed in a fine particle shape such as emulsion is exemplified. There is a tendency that by using such a wax, a recording product more excellent in abrasion resistance is obtained. In particular, there is a tendency that the wax contributes to improvement of abrasion resistance by being present on a surface of an ink coat film including the white color ink on the recording medium, that is, an interface between air and the ink coat film. Such a wax is not particularly limited, and examples thereof include an ester wax of higher fatty acid and higher monovalent alcohol or divalent alcohol, a paraffin wax, a microcrystalline wax, an olefin wax, or a mixture thereof.

Examples of the polyolefin wax include a wax manufactured from olefin such as ethylene, propylene, butylene or the derivatives and the copolymer, specifically, a polyethylene-based wax, a polypropylene-based wax, a polybutylene-based wax, and the like. As the polyolefin wax, a commercially available wax can be used. Specifically, Nopcote PEM17 (product name, manufactured by San Nopco Limited), Chemipar W4005 (product name, manufactured by Mitsui Chemicals Inc.), AQUACER515, AQUACER593 (all hereinabove are product names, manufactured by BYK Japan), and the like can be used.

The content of the wax is preferably 0.1% by mass to 5% by mass, preferably 0.2% by mass to 4% by mass, and preferably 0.3% by mass to 3% by mass, with respect to the total mass of the white color ink. As the content of the wax is 0.1% by mass or more, as described above, there is a tendency that abrasion resistance is further improved. In addition, as the content of the wax is 5% by mass or less, there is a tendency that a viscosity of the ink is lowered, discharge reliability is excellent, and clogging resistance is excellent. In addition, storage reliability of the ink is also favorable.

Anti-Foaming Agent

In the present embodiment, the white color ink may contain an anti-foaming agent. The anti-foaming agent is not particularly limited, and examples thereof include a silicone-based anti-foaming agent, a polyether-based anti-foaming agent, a fatty acid ester-based anti-foaming agent, and an acetylene glycol-based anti-foaming agent. Examples of the commercially available product of the anti-foaming agent include BYK-011, BYK-012, BYK-017, BYK-018, BYK-019, BYK-020, BYK-021, BYK-022, BYK-023, BYK-024, BYK-025, BYK-028, BYK-038, BYK-044, BYK-080A, BYK-094, BYK-1610, BYK-1615, BYK-1650, BYK-1730, and BYK-1770 (all hereinabove are product names, manufactured by BYK Japan). In addition, examples thereof include Surfynol DF37, DF110D, DF58, DF75, DF220, MD-20, and EnviroGem AD01 (all hereinabove are product names, manufactured by Nissin Chemical Co., Ltd.). One kind of the anti-foaming agent may be used alone, or two or more kinds thereof may be used by being mixed.

A content of the anti-foaming agent is preferably 0.03% by mass to 0.7% by mass, more preferably 0.05% by mass to 0.5% by mass, and further more preferably 0.08% by mass to 0.3% by mass, with respect to the total mass of the white color ink.

Other Components Contained

In the present embodiment, in the white color ink, in order to favorably maintain the storage reliability and discharge reliability of the ink jet head 2, to improve clogging, or to prevent deterioration of the white color ink, it is possible to appropriately add various additives such as a dissolution aid, a viscosity modifier, a pH modifier, an anti-oxidant, a preservative, an anti-fungal agent, a corrosion inhibitor, a moisturizer which is not an organic solvent, and a chelating agent for capturing a metal ion having an influence on dispersion.

Method of Preparing White Color Ink

In the present embodiment, the white color ink is obtained by mixing the above-described components in an optional order, and removing impurities by filtration and the like, depending on the necessity. As a method of mixing each component, a method of sequentially adding materials to a container with a stirrer such as a mechanical stirrer and a magnetic stirrer and performing stirring and mixing is appropriately used. As a filtration method, centrifugal filtration, filter filtration, and the like can be performed depending on the necessity.

Physical Properties of White Color Ink

In the present embodiment, an average particle diameter of the white color material in the white color ink is preferably 200 nm or more and more preferably 220 nm or more. Being within the range, whiteness is high, and the material can be used as a white color material. In addition, the average particle diameter of the white color material in the white color ink is preferably 380 nm or less and more preferably 350 nm or less. With the average particle diameter being within the range, sedimentation recovery properties of the white color material in the white color ink is excellent, and discharge reliability from the ink jet head 2 is high.

The average particle diameter of the white color material can be measured in the following manner. A dispersion solution obtained by dispersing the white color material in water is diluted by 1,000 times, for example, volume-based particle size distribution is obtained by using a dynamic light scattering (DLS) particle diameter distribution measuring device Nanotrac Wave II-EX150 (product name, manufactured by MicrotracBell Corporation). A median particle (D50) in the particle diameter distribution is set as the average particle diameter of the white color material.

In the present embodiment, surface tension of the white color ink at 25° C. is preferably 18 mN/m to 40 mN/m, more preferably 20 mN/m to 35 mN/m, and further more preferably 22 mN/m to 33 mN/m, from a viewpoint of balance between image quality and reliability for ink jet recording. For example, the surface tension can be measured by a Wilhelmy method using an automatic tensiometer CBVP-Z (product name, manufactured by Kyowa Interface Science Corporation). Specifically, when wetting a platinum plate with an ink in an environment of 25° C., it is possible to measure the surface tension by measuring the force of drawing the platinum plate in the ink.

In addition, from the same viewpoint, in the present embodiment, a viscosity of the white color ink at 25° C. is preferably 3 mPa·s (sec) to 10 mPa·s (sec), and more preferably 3 mPa·s (sec) to 8 mPa·s (sec). The viscosity can be measured by checking a value of the viscosity (mPa·s) at a shear rate of 200 $s^{-1}$ using a viscoelasticity tester MCR300 (product name, manufactured by Anton Paar) in an environment of 25° C.

Clear Ink

Hereinafter, components contained in the aqueous clear ink used in the present embodiment and components to be contained therein will be described. Clear ink is not an ink for coloring on a recording medium but an ink used for other purposes. The other purposes include improvement in abrasion resistance of a recording product, adjustment of glossiness of a recording medium, and the like, but are not limited thereto. For this reason, in the clear ink, other than the color material, the same composition as that of the aqueous white color ink can be exemplified. The clear ink is an ink which is different from a treatment solution to be described later, and does not contain a flocculant that flocculates components of the white color ink and the clear ink.

The recording medium used in the present embodiment includes a medium which has irregularity on the recording surface and tends to have poorer abrasion resistance than a recording medium having a recording surface with high smoothness. From this point, there is a tendency that abrasion resistance of the obtained recording product is improved by including a clear ink attachment step. As a method of attaching the clear ink onto a recording medium, similar to that of the white color ink, a method of discharging the clear ink from the ink jet head 2 by using an ink jet method is exemplified. The method is excellent from a viewpoint of capable of miniaturizing the ink jet recording apparatus 1.

Water

In the present embodiment, the clear ink contains water. Water is a medium that mainly forms the clear ink, and is a component that is evaporated and scattered by drying. Water is preferably water obtained by extremely removing ionic impurities such as pure water or ultrapure water, for example, ion exchange water, ultrafiltration water, reverse osmosis water, and distilled water. In addition, using water sterilized by ultraviolet light irradiation or hydrogen peroxide addition is preferable since it is possible to suppress generation of mold and bacteria in a case of storing the clear ink for a long period of time.

A content of water is preferably 40% by mass or more, more preferably 50% by mass or more, and further more preferably 60% by mass or more, with respect to a total mass of the clear ink. An upper limit of the content of water is not limited, and is preferably 99% by mass or less, for example.

Color Material

In the present embodiment, a content of the color material of the clear ink is preferably 0.2% by mass or less, more preferably 0.1% by mass or less, and further more preferably 0.05% by mass or less, with respect to the total mass of the clear ink, and a lower limit of the content is particularly preferably 0% by mass. Regarding a specific example of the color material, the same color material as the white color material exemplified in the aqueous white color ink can be used.

Organic Solvent

In the present embodiment, the clear ink preferably contains an organic solvent. With the clear ink containing an organic solvent, clogging resistance of the nozzle due to the ink jet method in recording becomes favorable.

The organic solvent used in the clear ink is preferably a water-soluble organic solvent. By using the water-soluble organic solvent, dryness of the clear ink becomes favorable, and it is possible to obtain an image excellent in image quality and abrasion resistance. As the water-soluble organic solvent, the same organic solvent as exemplified in the aqueous white color ink can be used.

A content of the organic solvent is preferably 1% by mass or more, more preferably 5% by mass or more, and further more preferably 10% by mass or more, with respect to a total mass of the clear ink. In addition, the content of the organic solvent is preferably 40% by mass or less, more preferably 35% by mass or less, and further more preferably 30% by mass or less, with respect to the total mass of the clear ink. When the content of the organic solvent is within the range, clogging resistance or abrasion resistance of the clear ink is more excellent, and thus is preferable.

A standard boiling point of the organic solvent is preferably 180° C. or more, more preferably 200° C. or more, and further more preferably 210° C. or more. In addition, the standard boiling point of the organic solvent is preferably 300° C. or less, more preferably 270° C. or less, and further more preferably 250° C. or less. When the standard boiling point of the organic solvent is within the range, clogging resistance or abrasion resistance of the ink is more excellent, and thus is preferable.

Resin

In the present embodiment, the clear ink preferably contains a resin. The resin has an operation of solidifying the clear ink and firmly fixing the ink solidification product on a recording medium. In the present embodiment, the resin may be in any state of a state of being dissolved in the clear ink and a state of being dispersed in the clear ink. As the resin in the dissolved state, the resin dispersant used when a pigment of the clear ink is dispersed can be used. In addition, as the resin in the dispersed state, a resin which is hardly soluble or insoluble to a liquid medium of the clear ink can be contained in a state of being dispersed in a fine particle shape, that is, in an emulsion state or a suspension state.

As the resin used in the present embodiment, the same resin as exemplified in the aqueous white color ink can be used. A lower limit value of the sum of the content of the resin is preferably 5% by mass or more, and more preferably 6% by mass or more, with respect to the total mass of the clear ink in terms of solid content. In addition, a lower limit of the content of the resin is preferably 11% by mass or less, and more preferably 10% by mass or less, with respect to the total mass of the clear ink. With the content of the resin being within the range, it is possible to ensure clogging resistance in recording, and to form an image excellent in abrasion resistance, even on a low-absorptive or non-absorptive recording medium with respect to the clear ink.

Surfactant

In the present embodiment, the clear ink preferably contains a surfactant. The surfactant is not particularly limited, but examples thereof include an acetylene glycol-based surfactant, a fluorine-based surfactant, and a silicone-based surfactant, and the surfactant preferably contains at least one of these, and more preferably contains a silicone-based surfactant among these. As the clear ink contains a silicone-based surfactant, dynamic surface tension of the clear ink is lowered. Therefore, it is possible to improve clogging resistance and to ensure discharge reliability.

As the surfactant used in the present embodiment, the same surfactant as exemplified in the aqueous white color ink can be used. In a case of containing the surfactant, the content can be 0.1% by mass to 1.5% by mass, and is preferably 0.5% by mass to 1% by mass, with respect to the total mass of the clear ink.

Wax

In the present embodiment, the clear ink may contain a wax. As the wax, a wax dissolved in the clear ink or a wax dispersed in a fine particle shape such as emulsion is exemplified. There is a tendency that by using such a wax, a recording product more excellent in abrasion resistance is obtained. In particular, there is a tendency that the wax contributes to improvement of abrasion resistance by being present on a surface of an ink coat film including the clear ink on the recording medium, that is, an interface between air and the ink coat film. Such a wax is not particularly limited, and examples thereof include an ester wax of higher fatty acid and higher monovalent alcohol or divalent alcohol, a paraffin wax, a microcrystalline wax, an olefin wax, or a mixture thereof.

As the wax used in the present embodiment, the same was as exemplified in the aqueous white color ink can be used. A content of the wax is preferably 0.1% by mass to 5% by mass, more preferably 0.2% by mass to 4% by mass, and preferably 0.3% by mass to 3% by mass, with respect to the total mass of the clear ink. As the content of the wax is 0.1% by mass or more, as described above, there is a tendency that abrasion resistance is further improved. In addition, as the content of the wax is 5% by mass or less, there is a tendency that a viscosity of the clear ink is lowered, discharge reliability is excellent, and clogging resistance is excellent. In addition, storage reliability of the ink is also favorable.

Anti-Foaming Agent

In the present embodiment, the clear ink may contain an anti-foaming agent. As the anti-foaming agent, the same anti-foaming agent as exemplified in the aqueous white color ink can be used. A content of the anti-foaming agent is preferably 0.03% by mass to 0.7% by mass, more preferably 0.05% by mass or 0.5% by mass, and further more preferably 0.08% by mass to 0.3% by mass, with respect to the total mass of the clear ink.

Other Components Contained

In the present embodiment, in the clear ink, in order to favorably maintain the storage reliability and discharge reliability of the ink jet head 2, to improve clogging, or to prevent deterioration of the white color ink, it is possible to appropriately add various additives such as a dissolution aid, a viscosity modifier, a pH modifier, an anti-oxidant, a preservative, an anti-fungal agent, a corrosion inhibitor, a moisturizer which is not an organic solvent, and a chelating agent for capturing a metal ion having an influence on dispersion.

Method of Preparing Clear Ink

In the present embodiment, the clear ink can be prepared by the same method as that of the aqueous white color ink.

Physical Properties of Clear Ink

In the present embodiment, surface tension of the clear ink at 25° C. is preferably 18 mN/m to 40 mN/m, more preferably 20 mN/m to 35 mN/m, and further more preferably 22 mN/m to 33 mN/m, from a viewpoint of balance between image quality and reliability for ink jet recording. For example, the surface tension can be measured by a Wilhelmy method using an automatic tensiometer CBVP-Z (product name, manufactured by Kyowa Interface Science Corporation). Specifically, when wetting a platinum plate with an ink in an environment of 25° C., it is possible to measure the surface tension by measuring the force of drawing the platinum plate in the ink.

In addition, from the same viewpoint, in the present embodiment, a viscosity of the clear ink at 25° C. is preferably 3 mPa·s (sec) to 10 mPa·s (sec), and more preferably 3 mPa·s (sec) to 8 mPa·s (sec). The viscosity can be measured by checking a value of the viscosity (mPa·s) at a shear rate of 200 $s^{-1}$ using a viscoelasticity tester MCR300 (product name, manufactured by Anton Paar) in an environment of 25° C.

Treatment Solution

Subsequently, a treatment solution used in the present embodiment will be described.

In the present embodiment, the treatment solution is a composition that flocculates components of the white color ink or the clear ink, and is preferably a composition including a flocculant flocculating the components of the white color ink or the clear ink. In the present embodiment, although the treatment solution is not necessarily used, it is possible to record an image with high image quality by using the treatment solution. A method of attaching the treatment solution onto a recording medium is not particularly limited, but examples thereof include a method of attaching a treatment solution onto a recording medium by using an ink jet method, a method of coating a treatment solution onto a recording medium by using a bar coater, or the like, similar to that of the aqueous white color ink or the clear ink. In particular, according to a method of discharging a treatment solution from the ink jet head 2 by using an ink jet method, it is possible to miniaturize the ink jet recording apparatus 1. As a component of the white color ink or the clear ink reacting with the treatment solution, a color material, a resin, or the like can be exemplified. In the treatment solution, a content of the color material is preferably 0.2% by mass or less, preferably 0.1% by mass or less, and more preferably 0.05% by mass or less, and a lower limit of the content of the color material is 0% by mass. The treatment solution is an auxiliary solution used by being attached onto the recording medium 10 before or at the same time when the white color ink or the clear ink is attached onto the recording medium 10.

In the treatment solution, containing of a component other than the color material of the white color ink or the clear ink, the content, properties, and the like, except for containing of a flocculant, can be adjusted independently from the white color ink or the clear ink. In the present embodiment, it is possible to record an image with high image quality by using the treatment solution. On the contrary, there is a case in which abrasion resistance or clogging resistance of the obtained image is lowered by using the treatment solution.

Flocculant

The treatment solution used in the present embodiment preferably contains a flocculant that flocculates components of the white color ink or the clear ink. As the treatment solution contains a flocculant, in the ink attachment step to be described later, the flocculant promptly reacts with a color material or a resin contained in the white color ink or the clear ink. With this, a dispersed state of the color material or the resin in the white color ink or the clear ink is destroyed, and the color material or the resin is flocculated, and the flocculated product inhibits permeation of the color material into the recording medium 10, and thus it is considered excellent from a viewpoint of improving image quality of the recording image.

Examples of the flocculant include a polyvalent metal salt, a cationic resin, an organic acid, and the like. One kind of the flocculants may be used alone, or two or more kinds thereof may be used in combination. Among these flocculants, at least one flocculant selected from the group consisting of the polyvalent metal salt, the organic acid, the cationic resin is preferably used, from a viewpoint of excellent reaction properties with the components contained in the white color ink or the clear ink.

The polyvalent metal salt is a water-soluble compound including a divalent or higher polyvalent metal ion and a negative ion bonding to the polyvalent metal ion. Specific examples of the polyvalent metal ion include a divalent metal ion such as $Ca^{2+}$, $Cu^{2+}$, $Ni^{2+}$, $Mg^{2+}$, $Zn^{2+}$, and $Ba^{2+}$; a trivalent metal ion such as $Al^{3+}$, $Fe^{3+}$, and $Cr^{3-}$; and the like. Examples of the negative ion include $Cl^-$, $I^-$, $Br^-$, $SO_4^{2-}$, $ClO^{3-}$, $NO^{3-}$, and $HCOO^-$, $CH_3COO^-$, and the like. Among these polyvalent metal salts, a potassium salt and a magnesium salt are preferable from a viewpoint of reliability and reaction properties as a flocculant of the treatment solution.

Examples of the organic acid preferably include a phosphoric acid, a polyacrylic acid, an acetic acid, a glycolic acid, a malonic acid, a malic acid, a maleic acid, an ascorbic acid, a succinic acid, a glutaric acid, a fumaric acid, a citric acid, a tartaric acid, a lactic acid, a sulfonic acid, an orthophosphoric acid, a pyrrolidone carboxylic acid, a pyrone carboxylic acid, a pyrrole carboxylic acid, a furancarboxylic acid, a pyridine carboxylic acid, a coumaric acid, a thiophene carboxylic acid, a nicotinic acid, or a derivative of the compound, or the salt thereof, for example. One kind of the organic acid may be used alone, or two or more kinds thereof may be used in combination. A polyvalent metal salt which is an organic acid salt is included in the polyvalent metal salt.

Examples of the cationic resin include a cationic urethane resin, a cationic olefin resin, a cationic amine-based resin, and the like. The cationic amine-based resin may be a resin having an amino group, and includes an allylamine resin, a polyamine resin, a quaternary ammonium salt polymer, a polyamide resin, and the like. As the polyamine resin, a resin having an amino group in the main skeleton of the resin is exemplified. As the allylamine resin, a resin having a structure derived from an allyl group in the main skeleton of the resin is exemplified. As the quaternary ammonium salt polymer, a resin having a quaternary ammonium salt in the structure is exemplified. As the polyamide resin, a resin having an amide group in the main skeleton of the resin and having an amino group in a side chain of the resin is exemplified. Among the cationic resin, the cationic amine-based resin is preferable since the cationic amine-based resin is excellent in reaction properties and easily acquired.

A content of the flocculant in the treatment solution is preferably 0.5% by mass or more, more preferably 1% by mass or more, and further more preferably 3% by mass or more, with respect to a total mass of the treatment solution. In addition, the content of the flocculant is preferably 15% by mass or less, more preferably 10% by mass or less, and further more preferably 5% by mass or less, with respect to the total mass of the treatment solution.

Water

The treatment solution used in the present embodiment is preferably an aqueous composition having water as a main solvent. The water is a component that is evaporated and diffused after attaching the treatment solution onto a recording medium. Water is preferably water obtained by extremely removing ionic impurities such as pure water or ultrapure water, for example, ion exchange water, ultrafiltration water, reverse osmosis water, and distilled water. In addition, using water sterilized by ultraviolet light irradiation or hydrogen peroxide addition is preferable since it is possible to suppress generation of mold and bacteria in a case of storing the white color ink for a long period of time. A content of water contained in the treatment solution can be 40% by mass or more, is preferably 50% by mass or more, more preferably 60% by mass or more, and further more preferably 70% by mass or more, for example, with respect to the total mass of the treatment solution. An upper limit of the content of water is not limited, but is preferably 99% by mass or less, for example.

Organic Solvent

The treatment solution used in the present embodiment may contain an organic solvent. By containing the organic solvent, it is possible to improve wettability of the treatment solution with respect to a recording medium. As the organic solvent, the same organic solvent as exemplified in the white color ink can be used. A content of the organic solvent is not particularly limited, but can be 10% by mass to 80% by mass, and is preferably 15% by mass to 70% by mass, with respect to the total mass of the treatment solution, for example.

A standard boiling point of the organic solvent can be included in a preferable range of the standard boiling point of an organic solvent that may be contained in the white color ink, independently from the standard boiling point of the organic solvent that may be contained in the white color ink. Or, the standard boiling point of the organic solvent is preferably 180° C. or more, more preferably 190° C. or more, and further more preferably 200° C. or more. In addition, the standard boiling point of the organic solvent is preferably 300° C. or less, more preferably 270° C. or less, and further more preferably 250° C. or less.

Surfactant

The treatment solution used in the present embodiment may be added with a surfactant. By adding a surfactant, it is possible to lower surface tension of the treatment solution and to improve wettability to the recording medium 10. Among the surfactant, for example, an acetylene glycol-based surfactant, a silicone-based surfactant, a fluorine-based surfactant can be preferably used. As a specific example of the surfactant, the same surfactant as exemplified in the white color ink can be used. A content of the surfactant is not particularly limited, but can be 0.1% by mass to 5% by mass, with respect to the total mass of the treatment solution.

Other Components

Depending on the necessity, a pH modifier, an antioxidant, a preservative/a fungicide, a corrosion inhibitor, a chelating agent, and the like may be added to the treatment solution used in the present embodiment.

Method of Preparing Treatment Solution

The treatment solution used in the present embodiment can be prepared by dispersing and mixing each of the components by an appropriate method. By performing filtration in order to remove coarse particles and foreign matter causing clogging, after sufficiently stirring each of the components, it is possible to obtain a targeted treatment solution.

Physical Properties of Treatment Solution

When the treatment solution used in the present embodiment is discharged from the ink jet head 2, surface tension at 25° C. is preferably 18 mN/m to 40 mN/m, more preferably 20 mN/m to 35 mN/m, and further more preferably 22 mN/m to 33 mN/m. For example, the surface tension can be measured by a Wilhelmy method using an automatic tensiometer CBVP-Z (product name, manufactured by Kyowa Interface Science Corporation). Specifically, when wetting a platinum plate with an ink in an environment of 25° C., it is possible to measure the surface tension by measuring the force of drawing the platinum plate in the ink.

In addition, from the same viewpoint, a viscosity of the treatment solution at 25° C. is preferably 3 mPa·s (sec) to 10 mPa·s (sec), and more preferably 3 mPa·s (sec) to 8 mPa·s (sec). The viscosity can be measured by checking a value of the viscosity (mPa·s) at a shear rate of 200 $s^{-1}$ using a viscoelasticity tester MCR300 (product name, manufactured by Anton Paar) in an environment of 25° C.

Recording Medium

In the present embodiment, it is possible to obtain an image excellent in abrasion resistance and image quality in recording on an ink absorptive, low ink absorptive, or non-ink absorptive recording medium. In particular, the present embodiment is desirably applicable to a non-ink absorptive or low-absorptive recording medium, on the surface of which a color material easily remains, to enable recording of an image excellent in abrasion resistance and image quality.

Examples of the ink-absorptive recording medium include a cloth such as cotton, silk, polyester, polyurethane, nylon; normal paper, ink jet exclusive paper, normal paper such as high quality paper or recycled paper with a median degree of absorbency, copy paper, ink jet exclusive paper provided with an ink accommodation layer having an ink absorbing function, and the like, having high ink absorbency, for example.

As the low-ink absorptive recording medium, a recording medium provided with a coating layer for accommodating an ink on the surface is exemplified. For example, printing main paper such as art paper, coating paper, and matt paper is exemplified. When the substrate is a plastic film, paper on which a hydrophilic polymer is coated on the surface such as polyvinyl chloride, polyethylene terephthalate, polycarbonate, polystyrene, polyurethane, polyethylene, and polypropylene, paper in which particles such as silica and titanium are coated with a binder, and the like are exemplified.

Examples of the non-ink absorptive recording medium include a recording medium in which plastic is coated on a substrate such as a plastic film, paper, and a cloth, a recording medium in which a plastic film is adhered on the substrate, which is not surface-treated for ink jet recording, that is, on which an ink absorption layer is not formed, or the like. Examples of the plastic referred herein include polyvinyl chloride, acryl, polyethylene terephthalate, polycarbonate, polystyrene, polyurethane, polyethylene, polypropylene, and the like.

Here, the "low-ink absorptive or non-absorptive recording medium" indicates "a recording medium in which a water absorption amount from contact start to 30 $msec^{1/2}$ in the Bristow method is 12 $mL/m^2$ or less". The Bristow method is a most common method as a method of measuring a liquid absorption amount in a short time, and is also employed in Japan Technical Association of the Pulp and Paper Industry (JAPAN TAPPI). Details of the test method are described in "the paper and board-liquid absorptive test method-Bristow method" of Standard No. 51 of "JAPAN TAPPI paper and pulp test method year 2000 edition".

White Color Recording Surface

The recording medium 10 used in the present embodiment preferably has a white color recording surface. The white color recording surface of the recording medium 10 is a surface on which recording is applied. Specifically, an L* value of the recording medium recording surface, measured by using a spectrophotometer based on CIELAB, for example, Spectrolino (product name, manufactured by GretagMacbeth), is 75 or more. An L* value of the white color recording surface is more preferably 80 or more, and further more preferably 85 or more. By using the recording medium 10 having such a white color recording surface, it is not only possible to form a white color image but also possible to impart designability with a sense of glossiness when attaching an aqueous white color ink. In addition, when the white color recording surface of the recording medium 10 used in the present embodiment is subjected to colorimetry using the spectrophotometer, an a* value and a b* value preferably satisfy $-4.5 \leq a^* \leq 2$ and $-10 \leq b^* \leq 3$, and more preferably satisfy $-2 \leq a^* \leq 1.5$ and $-7 \leq b^* \leq 2.5$.

Glossiness of White Color Recording Surface

In the recording medium 10 used in the present embodiment, the glossiness based on JIS Z 8741, ISO 2813 is preferably 30 or less, and more preferably 10 or less. Here, regarding the "glossiness based on JIS Z 8741, ISO 2813", for example, when a value of 60° gloss of the white color recording surface (ink non-attachment portion), measured by using a glossmeter GM-268 (product name, manufactured by Konica Minolta), is more than 10 and equal to or less than 70, the value is referred to as glossiness. In addition, when the value of 60° gloss is 10 or less, a value of 85° gloss is referred to as glossiness. In addition, when the value of 60° gloss is more than 70, a value of 20° gloss is referred to as glossiness.

In the present embodiment, the glossiness of the white color recording surface is preferably 30 or less, more preferably 20 or less, and further more preferably 10 or less. When the glossiness of the white color recording surface is 30 or less, it is possible to impart a sense of glossiness by attaching the aqueous white color ink or an aqueous clear ink. In addition, when the glossiness of the white color recording surface is 10 or less, it is not possible to cause a ratio of glossiness of the attachment portion of the aqueous clear ink to the white color recording surface after the drying to be two times or more only with the aqueous clear ink, but it is possible to impart a sense of glossiness by using the aqueous white color ink. A lower limit of the glossiness of the white color recording surface is preferably 0 or more, for example.

Centerline Average Roughness of White Color Recording Surface

In the present embodiment, a centerline average roughness Ra in the white color recording surface of the recording medium 10 is preferably 2 μm or more, more preferably 5 μm or more, and further more preferably 10 μm or more. An upper limit of the centerline average roughness Ra is not limited, but is preferably 150 μm or less, more preferably 100 μm or less, and further more preferably 50 μm or less, for example.

Here, the centerline average roughness Ra can be measured by using a laser microscope VK-9700 (product name, manufactured by Keyence), for example. At this time, cutoff values λc, λs were determined based on JIS B 0633/0651, ISO 4288/3274. Specifically, when Ra is 2 or less, as λc, 0.8 was used and as λs, 2.5 was used. When Ra was more than 2 and equal to or less than 10, as λc, 2.5 was used and as λs, 8 was used. When Ra is more than 10, as λc, 8 was used and as λs, 25 was used.

When the centerline average roughness Ra of the white color recording surface is 2 μm or more, it is possible to impart a sense of glossiness by attaching the aqueous white color ink or the aqueous clear ink. In addition, when the centerline average roughness Ra of the white color recording surface is 5 μm or more, it is not possible to set a ratio of glossiness of the attachment portion of the aqueous clear ink after drying to the white color recording surface to be two times only with the aqueous clear ink and it is possible to impart a sense of glossiness by using the aqueous white color ink.

As the recording medium 10 used in the present embodiment, a coat layer having a resin as a main component is preferably a recording surface. Examples of the resin include a polyvinyl chloride or acrylic resin, a urethane resin, and the like. As the main component of the recording surface is a resin, a recording surface having favorable fixability with respect to an aqueous ink jet ink containing an organic solvent, high abrasion resistance, and high image quality is obtained. In addition, by lowering ink absorbency, the color material easily remains on the recording surface, and a recording surface with a sense of glossiness is obtained. A content of the resin in the coat layer is 50% by mass or more, more preferably 70% by mass or more, and further more preferably 90% by mass or more, with respect to the entirety of the coat layer.

In addition, when the recording medium 10 used in the present embodiment is a recording medium having the recording surface, the recording medium 10 may have the recording surface and a member formed of other elements such as a support body. For example, a recording medium in which the coat layer is provided in a support body is exemplified. Examples of the support body include a cloth obtained by weaving a fiber in a plain weave, a twill weave, a satin weave, and the like. As the fiber, a synthetic fiber and the like are exemplified. Examples of the synthetic fiber include polypropylene, polyester, acetate, triacetate, polyamide, polyurethane, and the like. The cloth formed of a synthetic fiber is exemplified as a support body, and tarpaulin providing a resin layer formed of polyvinyl chloride on both sides of the support body is exemplified as an example of such a recording medium. The recording medium having such a cloth as a support body includes, for example, a banner, a flag, and a tapestry, and is used for a sign. Other examples of the support body include paper. Examples of such a recording medium include coating paper, art paper, wall paper, and the like. In particular, there are various types of wall papers having designability obtained by subjecting a recording surface to embossing step, and thus the wall paper has a relatively large centerline average roughness and is appropriate for the present embodiment.

In addition, the recording medium 10 used in the present embodiment may not include a resin coat layer on the recording surface. As an example of such a recording surface, a recording surface formed of a non-woven fabric is exemplified. The non-woven fabric refers to a fabric in a sheet shape obtained by interlacing a fiber not by weaving thereof. The fabric is a fabric obtained by adhering or interlacing a fiber by thermal, mechanical, or chemical operation. Examples of the fiber include a natural fiber, a synthetic fiber, and the like. As the natural fiber, a wood pulp fiber, a non-wood pulp fiber, and the like are exemplified, and examples thereof include cotton, hemp, wool, silk, and the like. Examples of the synthetic fiber include polypropylene, polyester, acetate, triacetate, polyamide, polyurethane, and the like. As an example of the recording medium having such a recording surface, wall paper in which the support body is paper is exemplified.

Ink Jet Recording Method

As the ink jet head, any one of a line head and a serial head may be used. The ink jet recording method in the present embodiment is a serial recording method using the ink jet recording apparatus 1 including the ink jet head 2, and recording is performed by alternately repeating main scanning of discharging an ink and attaching the ink onto the recording medium 10 while relatively moving the ink jet head 2 in a main scanning direction of the recording medium 10 and sub-scanning which is transporting of the recording medium 10 (refer to FIG. 2).

In a case of the serial recording method, the number of times of the main scanning in which a specific ink nozzle group opposes a recording position of the recording medium 10 and passes thereof is referred to as the number of main scanning of the ink. The number of main scanning is determined for each nozzle group. For example, when an ink is filled in one nozzle group of FIG. 3 and the nozzle group is used in recording, in a case in which a distance of one time of the sub-scanning is a distance half the length of the nozzle group in the sub-scanning direction, the number of the main scanning of the ink is 2. The number of the main scanning can be increased by shortening the distance of one time of the sub-scanning, and can be reduced by increasing the distance. The increased number of the main scanning is preferably in that it is possible to increase a total attachment amount of the attached ink, or it is possible to attach the ink by dividing the ink in a plurality of times of the main scanning. On the other hand, when the number of the main scanning is small, it is preferable in that the recording rate is fast. The number of the main scanning is referred to as the number of paths.

In the present embodiment, a maximum distance of one time of the main scanning is preferably 50 cm or more. The "maximum distance of one time of the main scanning" is referred to as a distance in which one point of the ink jet head 2 opposes the recording medium 10 when recording is performed from an end to the other end of the recording medium 10 in the main scanning direction, in one time of the main scanning. The distance is 50 to 500 cm, more preferably 50 to 400 cm, further more preferably 55 to 300 cm, and even further more preferably 60 to 200 cm. In addition, the distance is particularly preferably 70 to 190 cm, further particularly preferably 100 to 180 cm, and even further particularly preferably 130 to 170 cm. With the distance being 50 cm or more, it is possible to obtain a recording product useful for display. An upper limit of the distance is not particularly limited, but is preferably 500 cm or less from a viewpoint of the configuration of the ink jet recording apparatus 1. When performing recording, scanning of which the distance is shorter than the maximum distance of one time of the main scanning may be performed depending on the image to be recorded.

As the recording medium 10, a recording medium in which a width of the main scanning of the recording medium 10 is within the maximum distance range may be more preferably used. In this case, the recording medium is preferable since it is possible to set the maximum distance of one time of the main scanning as above.

In the present embodiment, the ink jet recording method includes an ink attachment step in the main scanning and a drying step after the main scanning. Depending on the case, the method may include a treatment solution attachment step at the same time of the ink attachment step or before the ink attachment step.

Treatment Solution Attachment Step

The treatment solution attachment step is a step of attaching the treatment solution reacting with the white color ink or the clear ink onto the recording medium 10. By attaching the treatment solution onto the recording medium 10, it is possible to improve image quality of the obtained print image. The treatment solution attachment method is not particularly limited, but in the present embodiment, it is preferable to discharge a treatment solution from the ink jet head 2 by using the ink jet method, from a viewpoint of miniaturization of the ink jet recording apparatus 1.

In the present embodiment, the treatment solution attachment step is before or at the same time of attaching the white color ink or the clear ink. In a case of arrangement of the nozzle group illustrated in FIG. 3, in general, the treatment solution attachment step is performed with the ink attachment step to be described later at the same time. However, by using only a nozzle on an upstream side of the treatment solution nozzle group in the sub-scanning direction for the treatment solution and using only a nozzle on a downstream side of the ink nozzle group in the sub-scanning direction for the white color ink or the clear ink, it is possible to attach the treatment solution before the white color ink or the clear ink. In addition, by using all the nozzles of the treatment solution nozzle group for the treatment solution, and using only the nozzle on the downstream side of the ink nozzle group in the sub-scanning direction for the white color ink or the clear ink, it is also possible to attach the treatment solution before or at the same time of attaching the white color ink or the clear ink.

In the present embodiment, in a recording region in which the white color ink or the clear ink and the treatment solution of the recording medium 10 are attached, a treatment solution attachment amount with respect to the ink attachment amount is preferably 5% by mass to 50% by mass, more preferably 9% by mass to 40% by mass, and further more preferably 12% by mass to 35% by mass. With the treatment solution attachment amount with respect to the ink attachment amount being within the range, it is possible to obtain more favorable image quality and to prevent deterioration of abrasion resistance of the obtained image. As the attachment amount of the white color ink or the clear ink and the treatment solution is increased, there is a tendency that abrasion resistance is deteriorated due to poor drying. For this reason, the amount in a region in which the attachment amount of the white color ink or the clear ink is the maximum is more preferably the treatment solution attachment amount with respect to the ink attachment amount.

It is preferable that the recording medium 10 is heated by the preheater 7 illustrated in FIG. 1 before the treatment solution attachment step, or by the IR heater 3 or the platen heater 4 illustrated in FIG. 1 in the treatment solution attachment step. By attaching the treatment solution onto the heated recording medium 10, the treatment solution discharged onto the recording medium 10 easily spreads out on the recording medium 10, and the treatment solution can be uniformly coated thereon. For this reason, the ink attached in the ink attachment step to be described later and the treatment solution sufficiently react with each other, and excellent image quality is obtained. In addition, since the treatment solution is uniformly coated on the recording medium 10, it is possible to reduce the coating amount and to prevent deterioration of abrasion resistance of the obtained image.

Here, a surface temperature of the recording medium 10 in attaching the treatment solution can be set dependent from the temperature in a preferable range of the surface temperature of the recording medium 10 in attaching the ink to be described later. For example, the surface temperature of the recording medium 10 in attaching the treatment solution is preferably 50° C. or less, more preferably 45° C. or less, and further more preferably 38° C. or less. In addition, a lower limit value of the surface temperature of the recording medium 10 in attaching the treatment solution is preferably 25° C. or more, and more preferably 28° C. or more. When the surface temperature of the recording medium 10 in attaching the treatment solution is within the range, it is possible to uniformly coat the treatment solution on the recording medium 10 and to improve abrasion resistance or image quality. In addition, it is possible to suppress influence of heat on the ink jet head 2.

Ink Attachment Step

The ink attachment step is a step of discharging the white color ink from the ink jet head 2 and attaching thereof onto the recording medium 10. By this step, an image is formed on the surface of the recording medium 10.

An attachment amount of the white color ink per unit area onto the recording medium 10 is preferably 8 mg/inch$^2$ or more, more preferably 12 mg/inch$^2$ or more, and further more preferably 14 mg/inch$^2$ or more. An upper limit of the attachment amount of the white color ink per unit area of the recording medium is not particularly limited, but, for example, is preferably 40 mg/inch$^2$ or less, more preferably 30 mg/inch$^2$ or less, further more preferably 28 mg/inch$^2$ or less, even more preferably 24 mg/inch$^2$ or less, and particularly preferably 20 mg/inch$^2$ or less. When the attachment amount is within the range, there is a tendency that a recording product having a sense of glossiness and excellent in abrasion resistance is obtained.

In the present embodiment, the ink attachment step may further include a step of attaching the clear ink onto the recording medium 10. The ink attachment step of the clear ink may be after attaching the white color ink, or at the same time of the attaching the white color ink. In a case of arrangement of the nozzle group illustrated in FIG. 3, in general, the ink attachment step of the clear ink is performed at the same time of the ink attachment step of the white color ink. However, for example, by using only a nozzle on the upstream side of the ink nozzle group in the sub-scanning direction for the white color ink, and using only a nozzle on the downstream side of the ink nozzle group in the sub-scanning direction for the clear ink, it is possible to attach the clear ink after the white color ink. In addition, by using all nozzles of the ink nozzle group for the white color ink, and using only the nozzle on the downstream side of the ink nozzle group in the sub-scanning direction for the clear ink, it is also possible to attach the clear ink after or at the same time of attaching the white color ink. By also attaching the clear ink in addition to the white color ink, it is possible to obtain a recording product excellent in abrasion resistance.

In a case of attaching the white color ink and the clear ink, an attachment amount of the white color ink per unit area onto the recording medium 10 is preferably 8 mg/inch$^2$ or more, more preferably 12 mg/inch$^2$ or more, and further more preferably 14 mg/inch$^2$ or more. An upper limit of the attachment amount of the white color ink per unit area of the recording medium 10 is not particularly limited, but, for example, is preferably 40 mg/inch$^2$ or less, more preferably 30 mg/inch$^2$ or less, further more preferably 28 mg/inch$^2$ or less, even more preferably 24 mg/inch$^2$ or less, and particularly preferably 20 mg/inch$^2$ or less. In addition, a lower limit of the sum of the attachment amount of the white color ink and the clear ink per unit area, overlappingly attached onto the recording medium 10, is not particularly limited, but is preferably 8 mg/inch$^2$ or more, more preferably 12 mg/inch$^2$ or more, and further more preferably 14 mg/inch$^2$ or more. An upper limit of the sum of the attachment amount of the white color ink and the clear ink per unit area, overlappingly attached onto the recording medium 10, is not particularly limited, but, for example, is preferably 40 mg/inch$^2$ or less, more preferably 30 mg/inch$^2$ or less, further more preferably 28 mg/inch$^2$ or less, even more preferably 24 mg/inch$^2$ or less, and particularly preferably 20 mg/inch$^2$ or less. When the attachment amount is within the range, there is a tendency that a recording product having a sense of glossiness and excellent in abrasion resistance is obtained.

In addition, an attachment amount of the clear ink per unit area onto the recording medium 10, in a case of attaching the white color ink and the clear ink, is preferably 0.5 mg/inch$^2$ or more, more preferably 1 mg/inch$^2$ or more, and further more preferably 5 mg/inch$^2$ or more. An upper limit of the attachment amount of the clear ink per unit area of the recording medium 10 is not particularly limited, but, for example, is preferably 20 mg/inch$^2$ or less, more preferably 15 mg/inch$^2$ or less, and further more preferably 12 mg/inch$^2$ or less.

The ink attachment step may include a heating step (hereinafter, also referred to as "primary heating step") of heating the recording medium 10 by the IR heater 3 or the platen heater 4 before the ink attachment step or at the same time of the ink attachment step, and is preferably performed on the recording medium 10 heated by the primary heating step. By the primary heating step, it is possible to promptly dry the ink on the recording medium 10 and to form an image excellent in image quality by suppressing bleeding.

An upper limit of the surface temperature of the recording medium 10 in attaching an ink onto the recording medium 10 by the primary heating step is preferably 50° C. or less, more preferably 45° C. or less, and further more preferably 40° C. or less. With the surface temperature of the recording medium in attaching the ink being within the range, it is possible to suppress influence of heat on the ink jet head 2 and to prevent clogging of the ink jet head 2 or the nozzle. In addition, a lower limit of the surface temperature of the recording medium 10 in ink jet recording is preferably a temperature higher than normal temperature, preferably 28° C. or more, more preferably 30° C. or more, and further more preferably 32° C. or more. With the surface temperature of the recording medium in attaching the ink being within the range, it is possible to promptly dry the ink on the recording medium 10 and fix the ink in an early stage, and to form an image excellent in image quality by suppressing bleeding.

A maximum time of one time of the main scanning in the ink attachment step is preferably 0.8 seconds or more, more preferably 0.8 seconds to 5 seconds, further more preferably 1.0 seconds to 4 seconds, particularly preferably 1.2 seconds to 2.5 seconds, and further particularly preferably 1.5 seconds to 2.0 seconds. With the maximum time of one time of the main scanning being within the range, it is appropriate for performing recording on the recording medium 10 of which the width is within the range.

"The maximum time of one time of the main scanning" is time in which one point of the ink jet head 2 opposes the recording medium 10 when recording is performed from an end to the other end of the recording medium 10 in the main scanning direction in one time of the main scanning. When performing recording, main scanning of a shorter time than the maximum time of one time of the main scanning may be performed depending on the image to be recorded. In addition, an average scanning rate in the ink attachment step is preferably 60 to 100 cm/seconds.

In the ink attachment step, the white color ink is attached onto a part of a recordable region of the recording medium 10, and a recording product may be obtained in which an attachment portion and a non-attachment portion of the white color ink are present on the recording surface of the recording medium 10. On the other hand, the white color ink may be attached onto the entirety of the recording surface of the recording medium 10. In the former case, a recording product having a different sense of glossiness in the non-attachment portion and the attachment portion of the recording medium 10 and having designability can be obtained, and thus the former case is preferable. In the latter case as well, a recording product having a different sense of glossiness from the sense of glossiness of the recording surface of the recording medium 10 can be obtained, and thus the latter case is preferable.

Drying Step

The ink jet recording method according to the present embodiment includes a step of drying the attached ink after the ink attachment step. Drying may be performed at normal temperature, or may be performed by heating the recording medium 10 onto which the ink is attached. Hereinafter, heating may be "secondary heating step". For example, heating may be the drying step of heating the recording medium 10, onto which the ink is attached, by the heater 5 illustrated in FIG. 1. As a heating unit, for example, a radiation type of radiating radioactive rays emitting heat to the recording medium 10 such as the IR heater, a transmission type of conducting heat from a member in contact with the recording medium 10 to the recording medium 10, a blast type of blowing warm air to the recording medium 10, and the like can be used. With this, a resin and the like contained in the ink on the recording medium 10 is melt and an ink film is formed, the ink film is firmly fixed on the recording medium 10 and becomes excellent in film forming properties, and an image excellent in abrasion resistance and having high image quality can be obtained. Thus, the heating unit is preferable.

An upper limit of the surface temperature of the recording medium 10 due to drying is preferably 120° C. or less, more preferably 110° C. or less, and further more preferably 100° C. or less. In addition, a lower limit of the surface temperature of the recording medium 10 is preferably 60° C. or more, more preferably 70° C. or more, and further more preferably 80° C. or more. With the temperature being within the range, it is possible to ensure clogging resistance and to obtain an image excellent in abrasion resistance and with high image quality in a short time.

After the drying step, a step of cooling the ink on the recording medium 10 by the cooling fan 6 illustrated in FIG. 1 may be included.

Other Steps

The recording method according to the present embodiment may include a cleaning step of discharging an ink or a treatment solution by a unit other than a pressure generation unit discharging an ink and performing recording, that is, by a mechanism other than a mechanism for discharging an ink for recording included in the ink jet head 2.

As the mechanism for discharging an ink for recording included in the ink jet head 2, a piezoelectric element included in a pressure chamber (not illustrated) and imparting a pressure to the ink or a heater element is exemplified. The cleaning step may be a step of discharging an ink or a treatment solution from a nozzle by imparting a pressure from an outside to the ink jet head 2. By including the step, even when there is a concern that a resin is deposited on an interior wall of the ink jet head 2, it is possible to suppress this and to make discharge reliability further excellent.

As other mechanisms in the cleaning step, a mechanism of imparting a negative pressure or imparting a positive pressure from upstream of the ink jet head 2. This is not the ink discharge by a function of the ink jet head 2 itself, that is, flushing. That is, when performing recording, it is not the discharge using a function of discharging ink from the ink jet head 2.

Hereinafter, the embodiment of the present disclosure will be further specifically described with reference to examples and comparative examples.

Preparation of White Color Pigment Dispersion Solution

As a white color material, titanium oxide which is a white color pigment was used. 25 g of titanium oxide (product name: CR-58, manufactured by Ishihara Sangyo Kaisha, Ltd.), 8.5 g of a dispersant (product name: Disparlon AQ-380, manufactured by Kosumoto Chemicals, Ltd.) which is not described in tables, and 66.5 g of water were mixed with one another, and zirconia beads having a diameter of 0.3 mm were dispersed at a filling rate: 60 volume % and 8 m/s for 5 minutes to obtain a titanium oxide dispersant having a solid concentration of 25% by mass.

The titanium oxide dispersion solution was distilled at 1,000 times, and a volume-based particle diameter distribution was obtained by using a dynamic light scattering (DLS) particle diameter distribution measuring device Nanotrac Wave II-EX150 (product name, manufactured by Microtrac-Bell Corporation). A median particle (D50) in the particle diameter distribution was 280 nm.

Preparation of Treatment Solution and Ink

Each of the components were mixed with one another and stirred so as to obtain the mixture ratio described in Tables 1 and 2, and filtration was performed using a membrane filter having a pore diameter of 5 μm to obtain a treatment solution A and inks A to E. All numerical values in Tables 1 and 2 indicate % by mass, and water was added such that the total mass of the ink was 100% by mass. In addition, regarding the white color material and the resin described in Table 2, a value in terms of solid content was indicated.

TABLE 1

| | | Treatment solution A |
|---|---|---|
| Organic solvent | Propylene glycol | 15 |
| | 2-pyrrolidone | 10 |
| Flocculant | Calcium acetate-hydrate | 5 |
| Anti-foaming agent | Surfynol DF110D | 0.1 |
| Surfactant | BYK348 | 1 |
| Pure water | — | Residue |
| | Sum | 100 |

TABLE 2

| | | Ink A | Ink B | Ink C | Ink D | Ink E |
|---|---|---|---|---|---|---|
| Organic solvent | Propylene glycol | 10 | 10 | 10 | 10 | 10 |
| | 2-pyrrolidone | 10 | 10 | 10 | 10 | 10 |
| White color material | Titanium oxide (solid content) | 8 | | 5 | 3 | 8 |
| Resin | Joncryl 62J | 6 | 7 | 6 | 6 | 10 |
| Wax | AQUACER539 | 1 | 2 | 1 | 1 | 1 |
| Anti-foaming agent | Surfynol DF110D | 0.1 | 0.1 | 0.1 | 0.1 | 0.1 |
| Surfactant | BYK348 | 1 | 1 | 1 | 1 | 1 |
| Pure water | — | Residue | Residue | Residue | Residue | Residue |
| | Sum | 100 | 100 | 100 | 100 | 100 |

Details of substances described in Tables 1 and 2 are as follows.

Flocculant: Calcium acetate-hydrate (polyvalent metal salt, manufactured by Fuji Film Wako Pure Chemical Co., Ltd.)

Anti-foaming agent: Surfynol DF110D (product name, acetylenediol-based surfactant, manufactured by Nissin Chemical Co., Ltd.)

Surfactant: BYK348 (product name: silicone-based surfactant, manufactured by BYK Japan)

White color material: Titanium oxide (product name: CR-58, white color pigment, manufactured by Ishihara Sangyo Kaisha, Co., Ltd.)

Resin: Joncryl 62J (product name, manufactured by styrene acrylic resin, manufactured by BASF Japan Corporation)

Wax: AQUACER 539 (product name, aqueous modified paraffin wax emulsion, manufactured by BYK Japan)

Recording medium

As the recording medium, five kinds of the following M1 to M5 were used.

M1: PRSO400F (product name, vinyl chloride resin wall paper, manufactured by Lintec Sign System Inc.)

M2: H7806-0401 (product name, acrylic resin cloth, manufactured by Hitec Co., Ltd.)

M3: 3686 Trisolv Prime Art Paper (product name, coat paper, manufactured by Seal Corporation)

M4: DV662 (product name, non-vinyl chloride resin wall paper, manufactured by Neschen Corporation)

M5: Orajet 3169G (product name, vinyl chloride-based film, manufactured by Orafol Corporation)

TABLE 3

| Recording medium | Product name | L*value | Glossiness | Centerline average roughness Ra (μm) |
|---|---|---|---|---|
| M1 | PRSO400F | 94.9 | 1.0 | 11.3 |
| M2 | H7806-0401 | 82.3 | 2.0 | 16.4 |
| M3 | 3686 Trisolv PrimeArt Paper | 94.6 | 26.7 | 2.2 |
| M4 | DV662 | 95.7 | 14.0 | 3.9 |
| M5 | Orajet 3169G | 92.9 | 71.8 | 1.5 |

A method of measuring physical properties of a recording medium described in Table 3 is as follows. L* value With respect to the white color recording surface (ink non-attachment portion) of the recording medium, measurement was performed by using a spectrophotometer Spectrolino (product name, manufactured by GretagMacbeth). Measurement was performed three times by changing the position, and the average value was set as a L* value of the recording surface.

Glossiness

With respect to the white color recording surface (ink non-attachment portion) of the recording medium, measurement was performed by using a glossmeter GM-268 (product name, manufactured by Konica Minolta). Measurement was performed three times by changing the position, and the average value was set as glossiness of the recording surface. When a value of 60° glossiness was more than 10 and equal to or less than 70, the value was set as glossiness. In addition, when the value of 60° glossiness was equal to or less than 10, a value of 85° glossiness was set as glossiness. When the value of 60° glossiness was more than 70, a value of 20° glossiness was set as glossiness. Centerline average roughness Ra With respect to the white color recording surface (ink non-attachment portion) of the recording medium, measurement was performed by using a laser microscope VK-9700 (product name, manufactured by Keyence). The measurement range was 1.4 mm×1.4 mm, measurement was performed three times by changing the position, and the average value was set as Ra of the recording surface. At this time, cutoff values λc, λs were set as follows. When Ra was equal to or less than 2, as λc, 0.8 was used and as λs, 2.5 was used. When Ra was more than 2 and equal to or less than 10, as λc, 2.5 was used and as λs, 8 was used. When Ra was more than 10, as λc, 8 was used and as λs, 25 was used.

Recording Method

An ink and a treatment solution were discharged in a predetermined region with respect to the recording medium described in the tables to record a beta pattern, using the ink and the treatment solution described in Tables 1 and 2. As the ink jet recording apparatus, a remodeling machine obtained by installing a secondary heater in an ink jet printer SC-S80650 (product name, manufactured by Seiko Epson Corporation) was used. A white color ink (ink A, or any of inks C to E) was filled in the ink nozzle group 15*a* of FIG. 3, a clear ink (ink B) was filled in the ink nozzle group 15*b*, and a treatment solution was filled in the treatment solution nozzle group 16. In each example, recording was performed under the condition described in Table 4. A recording resolution of the ink was set to 1440×1440 dpi, and a dot weight of the ink was set to 20 ng/dot. An attachment amount of the treatment solution is indicated in % by mass with respect to an attachment amount of the ink, and dot density of the dot was adjusted such that the attachment amount was a value in the tables. Regarding Example 11, adjustment was performed such that the ink attachment amount of the ink A (white color ink) was 15 mg/inch$^2$, and the ink attachment amount of the ink B (clear ink) was 10 mg/inch$^2$. Attachment of the ink was performed eight times in the main scanning. Here, regarding Example 11, recording was performed as follows. For the ink A, only the upstream half of the ink nozzle group 15*a* was used, for the ink B, only the downstream half of the ink nozzle group 15*b* was used, and recording was performed eight times in each main scanning. In addition, regarding Examples 14 and 15, recording was performed as follows. For the treatment solution A, only the upstream ⅓ of the treatment solution nozzle group 16 was used, for the ink A, only the downstream ⅔ of the ink nozzle group 15*a* was used, recording of the treatment solution A was performed four times in the main scanning direction, and recording of the ink A was performed eight times in the main scanning. Each nozzle group is constituted of 2 nozzle arrays deviated by half pitch, and nozzle density of each nozzle array is 360 npi (nozzle/inch). Therefore, the nozzle density of each nozzle group including two nozzle arrays is 720 npi. A surface temperature of the recording medium was adjusted such that thermoelectric couple was installed in the recording medium and the primary heating temperature was 35° C. In addition, the secondary heating temperature was 90° C.

TABLE 4

| | Treatment solution | Treatment solution attachment amount (with respect to % by mass of ink) | Ink | Ink attachment amount (mg/inch$^2$) | Recording medium | Glossiness (ink attachment portion) | Glossiness ratio (with respect to white color recording surface) | Sense of glossiness (Visual view) | Abrasion resistance |
|---|---|---|---|---|---|---|---|---|---|
| Example 1 | — | — | Ink A | 15 | M1 | 2.7 | 2.7 | B | A |
| Example 2 | — | — | Ink A | 10 | M1 | 2.3 | 2.3 | C | A |
| Example 3 | — | — | Ink A | 18 | M1 | 3.0 | 3.0 | A | A |
| Example 4 | — | — | Ink A | 25 | M1 | 3.0 | 3.0 | A | C |
| Example 5 | — | — | Ink A | 32 | M1 | 4.5 | 4.5 | A | D |
| Example 6 | — | — | Ink A | 15 | M2 | 6.6 | 3.3 | A | B |
| Example 7 | — | — | Ink A | 10 | M2 | 4.8 | 2.4 | B | B |
| Example 8 | — | — | Ink A | 15 | M3 | 54.0 | 2.0 | A | A |
| Example 9 | — | — | Ink A | 15 | M4 | 38.2 | 2.7 | A | A |
| Example 10 | — | — | Ink A | 25 | M4 | 49.6 | 3.5 | A | C |
| Example 11 | — | — | Ink A/B | 15/10 | M1 | 2.7 | 2.7 | B | A |
| Example 12 | — | — | Ink C | 15 | M1 | 2.0 | 2.0 | C | A |
| Example 13 | — | — | Ink E | 25 | M1 | 3.0 | 3.0 | A | A |
| Example 14 | Treatment solution A | 20 | Ink A | 15 | M1 | 2.3 | 2.3 | C | B |
| Example 15 | Treatment solution B | 20 | Ink A | 15 | M2 | 5.2 | 2.6 | B | C |
| Comparative Example 1 | — | — | Ink A | 6 | M1 | 1.9 | 1.9 | D | A |
| Comparative Example 2 | — | — | Ink A | 6 | M2 | 3.8 | 1.9 | D | A |
| Comparative Example 3 | — | — | Ink A | 6 | M3 | 30.1 | 1.1 | D | A |
| Comparative Example 4 | — | — | Ink D | 15 | M1 | 1.5 | 1.5 | D | A |
| Comparative Example 5 | — | — | Ink A | 15 | M5 | 26.0 | 0.4 | E | A |
| Comparative Example 6 | — | — | Ink B | 15 | M5 | 29.0 | 0.4 | E | A |
| Reference Example 1 | — | — | Ink B | 15 | M1 | 2.0 | 2.0 | D | A |
| Reference Example 2 | — | — | Ink B | 12 | M1 | 1.8 | 1.8 | D | A |
| Reference Example 3 | — | — | Ink B | 25 | M1 | 2.4 | 2.4 | D | C |
| Reference Example 4 | — | — | Ink B | 15 | M2 | 2.2 | 1.1 | D | A |
| Reference Example 5 | — | — | Ink B | 15 | M3 | 55.0 | 2.1 | A | A |
| Reference Example 6 | — | — | Ink B | 15 | M4 | 42.9 | 3.1 | A | A |
| Reference Example 7 | — | — | Ink A | 10 | M3 | 38.0 | 1.4 | C | A |

Evaluation Method

Sense of Glossiness (Visual View)

The ink and the treatment solution were filled in the ink jet printer, a beta pattern was printed, and a print material was visually observed.

The evaluation criteria are as follows. If the result was evaluation C or more, it was determined that there was no problem.

A: A sense of glossiness is prominently present compared to a non-print portion.

B: A sense of glossiness is present compared to a non-print portion.

C: A sense of glossiness is present depending on the angle compared to a non-print portion.

D: A sense of glossiness is present at the same angle as that of a non-print portion.

E: A matt sense is present compared to a non-print portion.

Glossiness

The ink and the treatment solution were filled in the ink jet printer, a beta pattern was printed, and measurement was performed on the recording surface (ink attachment portion) by using glossmeter GM-268 (product name, manufactured by Konica Minolta). Measurement was performed three times by changing the position, and the average value was set as glossiness of the recording surface. When a value of 60° glossiness was more than 10 and equal to or less than 70, the value was set as glossiness. In addition, when the value of 60° glossiness was equal to or less than 10, a value of 85° glossiness was set as glossiness. When the value of 60° glossiness was more than 70, a value of 20° glossiness was set as glossiness.

Abrasion Resistance

The ink and the treatment solution were filled in the ink jet printer, and a beta pattern was printed. A beta pattern print portion was cut in a rectangle of 30×150 mm, a degree of ink peeling when performing rubbing 30 times with a vibration type abrasion resistance tester (500 g of load) using a plain-woven fabric was visually evaluated.

The evaluation criteria are as follows.

A: There is no peeling.

B: Equal to or less than 10% of peeling is present in the evaluation area.

C: Equal to 10% and Less than 50% of peeling is present in the evaluation area.

D: Equal to or more than 50% of peeling is present in the evaluation area.

Evaluation Result

The result of evaluation test is shown in Table 4. In any of Examples, a ratio of glossiness of the attachment portion of the aqueous white color ink to the white color recording surface was two times or more, and a recording product having a sense of glossiness was obtained. With respect to this, in any of Comparative Examples, a ratio of glossiness of the attachment portion of the aqueous white color ink to the white color recording surface was less than two times, and a recording product having a sense of glossiness was not obtained. Hereinafter, details are described.

In all of Examples 1 to 7 in which a white color ink was attached onto a recording medium (M1, M2) in which glossiness of the white color recording surface was equal to or less than 10, a recording product having a sense of glossiness was obtained. By increasing an attachment amount of the white color ink, there was a tendency that glossiness was increased. However, there was a tendency that dryness was deteriorated due to the increase in the attachment amount, and abrasion resistance was lowered. In addition, as in Comparative Examples 1 and 2, when the attachment amount of the white color ink was small, a recording product having a sense of glossiness was not obtained. In addition, as in Reference Examples 1 to 4, when only a clear ink was attached instead of the white color ink, a recording product having a sense of glossiness was not obtained.

Even in Examples 8 to 10 in which the white color ink was attached onto the recording medium (M3, M4) in which glossiness of the white color recording surface was 10 to 30, the same recording product having a sense of glossiness was obtained. By increasing the attachment amount of the white color ink, there was a tendency that glossiness was increased. However, there was a tendency that dryness was deteriorated due to the increase in the attachment amount, and abrasion resistance was lowered. In addition, as in Comparative Example 3, when the attachment amount of the white color ink was small, a recording product having a sense of glossiness was not obtained. In addition, as in Reference Examples 5 and 6, when only the clear ink was attached instead of the white color ink, in the recording medium, similar to the case of the white color ink, a recording product having a sense of glossiness was obtained. In addition, as in Reference Example 7, in the recording medium, even when a ratio of glossiness of the attachment portion of the white color ink to the white color recording surface was less than two times, a recording product having a sense of glossiness was obtained.

In Example 11 in which the clear ink was attached, overlapping the white color ink, a recording product excellent in abrasion resistance while having a poorer sense of glossiness was obtained, compared to Example 4 in which only the white color ink having the same total attachment amount of the ink.

In Example 12 using the white color ink in which the content of the white color pigment as a white color material was decreased, the glossiness was lowered compared to Example 1. In addition, as Comparative Example 4, when the content of the white color pigment was smaller than 5% by mass, a recording product having a sense of glossiness was not obtained.

In Example 13 using the white color ink in which the content of a resin was increased, a recording product excellent in abrasion resistance was obtained.

In Examples 14 and 15 in which a treatment solution was attached in addition to the white color ink, there was a tendency that the glossiness of the recording product was lowered and abrasion resistance was deteriorated. Here, since it is possible to suppress bleeding by using the treatment solution, it is possible to obtain an elaborate image having high designability. In addition, a recording product having a sense of glossiness is obtained by increasing the attachment amount of the white color ink, and it is possible to obtain a recording product excellent in abrasion resistance by using the clear ink in combination.

In Comparative Examples 5 and 6 in which the white color ink or the clear ink was attached onto the recording medium (M5) having high glossiness of the white color recording surface, the glossiness of the ink attachment portion was lowered than the glossiness of the white color recording surface, and a recording product having a sense of glossiness was not obtained.

The present disclosure is not limited to the above-described examples, and various modifications can be made. For example, the present disclosure has substantially the same configuration (for example, configuration having the same function, method, and result, or configuration having the same object and effect) as the configuration described in the examples. In addition, the present disclosure has a configuration in which non-essential portions of the configuration described in the examples are replaced. In addition, the present disclosure has a configuration exhibiting the same effect as that of the configuration described in the examples or a configuration capable of achieving the same object as that of the configuration described in the examples. In addition, the present disclosure has a configuration added with a known technique to the configuration described in the examples.

Hereinafter, the content derived from the examples is described.

The ink jet recording method of the present application includes an ink attachment step of attaching an aqueous white color ink containing a white color material onto a recording medium having a white color recording surface with glossiness of 30 or less, at an L* value of 75 or more, by an ink jet method, and a drying step of drying the recording medium onto which the aqueous white color was attached, and a glossiness of the attachment portion of the aqueous white color ink after drying with respect to the white color recording surface is two times or more.

According to the method of the present application, it is possible to obtain a recording surface having a sense of glossiness by attachment of the aqueous white color ink, using a recording medium having a white color recording surface with glossiness of 30 or less. In particular, in the aqueous white color ink using titanium oxide to the white color material, since a refractive index of titanium oxide is high, a light amount reflected against an incident light is large, image quality is changed with respect to a white color recording surface having low gloss with glossiness of 30 or less, and thus it is possible to obtain a recording product having a sense of glossiness. In addition, by including the drying step, it is possible to obtain a favorable image without bleeding even on a low-absorptive or non-absorptive recording medium such as coated paper. By making glossiness of the attachment portion of the aqueous white color ink after drying two times or more with respect to the white color recording surface, that is, a non-attachment portion, it is possible to obtain a recording product having a sense of glossiness.

In the ink jet recording method, an attachment amount of the aqueous white color ink per unit area of the recording medium in the ink attachment step is preferably 8 mg/inch$^2$ or more.

According to the method, a recording product having a better sense of glossiness is obtained by setting the attachment amount of the aqueous white color ink to be 8 mg/inch$^2$ or more.

In the ink jet recording method, a content of the white color material in the aqueous white color ink is preferably 5% by mass to 14% by mass.

According to the method, a recording product having a better sense of glossiness is obtained by setting the content of the white color material in the aqueous white color ink to be 5% by mass or more. In addition, it is possible to ensure discharge reliability of the aqueous white color ink in the ink jet method by setting the content of the white color material in the aqueous white color ink to be 14% by mass or less.

In the ink jet recording method, an average particle diameter of the white color material is preferably 200 nm to 380 nm.

According to the method, a recording product having a better sense of glossiness is obtained by setting the average particle diameter of the white color material contained in the aqueous white color ink to be 200 nm or more. In addition, it is possible to further ensure discharge reliability or sedimentation recovery properties of the aqueous white color ink in the ink jet method by setting the average particle diameter of the white color material to be 380 nm or less.

In the ink jet recording method, the aqueous white color ink contains a resin, and a content of the resin in the aqueous white color ink is preferably 5% by mass to 11% by mass.

According to the method, it is possible to obtain a recording product more excellent in abrasion resistance by setting the content of the resin to be 5% by mass or more. In addition, it is possible to further ensure discharge reliability of the aqueous white color ink in the ink jet method by setting the content of the resin to be 11% by mass or less.

In the ink jet recording method, glossiness of the white color recording surface of the recording medium is preferably 10 or less.

According to the method, it is possible to obtain a recording surface having a better sense of glossiness by attaching an aqueous white color ink, using the white color recording surface having glossiness of 10 or less.

In the ink jet recording method, a centerline average roughness Ra in the white color recording surface of the recording medium is preferably 2 μm or more.

According to the method, it is possible to obtain a recording surface having a better sense of glossiness by attaching an aqueous white color ink, using a recording medium having a white color recording surface with a centerline average roughness Ra of 2 μm or more.

In the ink jet recording method, the recording medium is preferably a low-absorptive recording medium or a non-absorptive recording medium.

According to the method, it is possible to effectively cause a color material to remain on a recording surface and to obtain a recording surface having a better sense of glossiness by using a low-absorptive or non-absorptive recording medium.

In the ink jet recording method, the ink attachment step preferably further includes a step of attaching an aqueous clear ink on the recording medium.

According to the method, it is possible to obtain a recording product more excellent in abrasion resistance by further attaching an aqueous clear ink on the recording medium.

In the ink jet recording method, a surface temperature of the recording medium in attaching the ink is preferably 28° C. to 50° C.

According to the method, a favorable image without bleeding is obtained by setting the surface temperature of the recording medium to be 28° C. or more. In addition, it is possible to further ensure clogging resistance of the nozzle in the ink jet method by setting the surface temperature of the recording medium to be 50° C. or less.

In the ink jet recording method, in the drying step, the recording medium is preferably dried at a surface temperature of the recording medium of 60° C. to 120° C.

According to the method, more favorable abrasion resistance is obtained even in the low-absorptive or non-absorptive recording medium by drying the recording medium at 60° C. or more. In addition, it is possible to further prevent defects such as modification of the recording medium due to heat by drying the recording medium at 120° C. or less.

The ink jet recording apparatus of the present application performs recording by any one of the ink jet recording methods described above. According to the ink jet recording apparatus of the present application, it is possible to prepare a recording product having a sense of glossiness by attaching an aqueous white color ink onto a recording medium having irregularity on the white color recording surface.

What is claimed is:

1. An ink jet recording method comprising:

an ink attachment step of attaching an aqueous white color ink containing a white color material onto a recording medium having a white color recording surface with glossiness of 30 or less at an L* value of 75 or more, by an ink jet method; and a drying step of drying the recording medium onto which the aqueous white color ink is attached, wherein a ratio of glossiness of an attachment portion of the aqueous white color ink to the white color recording surface after the drying is two times or more.

2. The ink jet recording method according to claim 1, wherein an attachment amount of the aqueous white color ink per unit area of the recording medium in the ink attachment step is 8 mg/inch$^2$ or more.

3. The ink jet recording method according to claim 1, wherein a content of the white color material in the aqueous white color ink is 5% by mass to 14% by mass.

4. The ink jet recording method according to claim 1, wherein an average particle diameter of the white color material is 200 nm to 380 nm.

5. The ink jet recording method according to claim 1, wherein the aqueous white color ink contains a resin, and a content of the resin in the aqueous white color ink is 5% by mass to 11% by mass.

6. The ink jet recording method according to claim 1, wherein glossiness of the white color recording surface of the recording medium is 10 or less.

7. The ink jet recording method according to claim 1, wherein a centerline average roughness Ra in the white color recording surface of the recording medium is 2 μm or more.

8. The ink jet recording method according to claim 1, wherein the recording medium is a low-absorptive recording medium or a non-absorptive recording medium.

9. The ink jet recording method according to claim 1, wherein the ink attachment step further includes attaching an aqueous clear ink onto the recording medium.

10. The ink jet recording method according to claim 1, wherein a surface temperature of the recording medium in the attaching of an ink is 28° C. to 50° C.

11. The ink jet recording method according to claim 1, wherein in the drying step, a surface of the recording medium is dried at 60° C. to 120° C.

12. An ink jet recording apparatus which performs recording by the ink jet recording method according to claim 1.

* * * * *